US011532213B2

(12) United States Patent
Kogo

(10) Patent No.: US 11,532,213 B2
(45) Date of Patent: Dec. 20, 2022

(54) GAME SYSTEM, TYPING GAME APPARATUS AND SERVER

(75) Inventor: Junichi Kogo, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1476 days.

(21) Appl. No.: 11/338,834

(22) Filed: Jan. 25, 2006

(65) Prior Publication Data

US 2006/0166743 A1 Jul. 27, 2006

(30) Foreign Application Priority Data

Jan. 26, 2005 (JP) ..... JP2005-018582

(51) Int. Cl.
*G07F 17/32* (2006.01)

(52) U.S. Cl.
CPC ..... *G07F 17/3269* (2013.01); *G07F 17/32* (2013.01)

(58) Field of Classification Search
CPC ..... G07F 17/3269; G07F 17/32
USPC ..... 463/36, 42
See application file for complete search history.

(56) References Cited

U.S. PATENT DOCUMENTS 5,581,270 A * 12/1996 Smith et al. ..... 345/2.1
6,379,252 B2 * 4/2002 Takata et al. ..... 463/43
6,847,778 B1 * 1/2005 Vallone ..... G06F 3/04847 386/205
2002/0018983 A1 * 2/2002 Dixon ..... 434/227
2003/0014630 A1 * 1/2003 Spencer ..... G06F 21/10 713/168

FOREIGN PATENT DOCUMENTS

JP 2004-134880 4/2004

* cited by examiner

*Primary Examiner* — Thomas H Henry
(74) *Attorney, Agent, or Firm* — Simpson & Simpson, PLLC; S. Peter Konzel

(57) ABSTRACT

A game system includes: a typing game apparatus; and a server, wherein: the server includes: a server communication unit for communicating with the typing game apparatus; a clock unit for clocking the time and date; a storage unit for storing game data with a definite usable term for use in the typing game; a time limit judgment unit for judging expired data that an usable term of game data passes; and a command unit for issuing a deletion command for deleting the expired data based on the judgment result to the typing game apparatus; and the typing game apparatus includes: a game communication unit for communicating with the server; a game control unit for controlling a typing game; a data storage unit for storing the game data; and a data management unit for deleting the expired data based on the deletion command.

17 Claims, 18 Drawing Sheets

FIG. 10

SONG DATA LIST IN USE

| SONG NAME | ARTIST NAME | SONG DATA | START OF TERM | END OF TERM | DOWNLOAD REQUIRED | WARNING | OVERDUE |
|---|---|---|---|---|---|---|---|
| SONG (A) | ARTIST (a) | SONG DATA (A) | 2003. 12.01 | 2004. 12.01 | — | — | — |
| SONG (B) | ARTIST (b) | SONG DATA (B) | 2003. 12.25 | 2004. 12.25 | — | — | — |
| SONG (C) | ARTIST (a) | SONG DATA (C) | 2004. 05.01 | 2005. 05.01 | — | — | — |
| SONG (D) | ARTIST (c) | SONG DATA (D) | 2004. 10.01 | 2005. 10.01 | — | — | — |

LATEST SONG DATA LIST

| SONG NAME | ARTIST NAME | SONG DATA | START OF TERM | END OF TERM | DOWNLOAD REQUIRED | WARNING | OVERDUE |
|---|---|---|---|---|---|---|---|
| SONG (E) | ARTIST (d) | SONG DATA (E) | 2004. 12.01 | 2005. 12.01 | — | — | — |
| SONG (F) | ARTIST (b) | SONG DATA (F) | 2004. 12.01 | 2005. 12.01 | — | — | — |

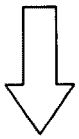

SONG DATA LIST

| SONG NAME | ARTIST NAME | SONG DATA | START OF TERM | END OF TERM | DOWNLOAD REQUIRED | WARNING | OVERDUE |
|---|---|---|---|---|---|---|---|
| SONG (A) | ARTIST (a) | SONG DATA (A) | 2003. 12.01 | 2004. 12.01 | — | — | — |
| SONG (B) | ARTIST (b) | SONG DATA (B) | 2003. 12.25 | 2004. 12.25 | — | — | — |
| SONG (C) | ARTIST (a) | SONG DATA (C) | 2004. 05.01 | 2005. 05.01 | — | — | — |
| SONG (D) | ARTIST (c) | SONG DATA (D) | 2004. 10.01 | 2005. 10.01 | — | — | — |
| SONG (E) | ARTIST (d) | SONG DATA (E) | 2004. 12.01 | 2005. 12.01 | — | — | — |
| SONG (F) | ARTIST (b) | SONG DATA (F) | 2004. 12.01 | 2005. 12.01 | — | — | — |

FIG. 12

| SONG NAME | ARTIST NAME | SONG DATA | START OF TERM | END OF TERM | DOWNLOAD REQUIRED | WARNING | OVERDUE |
|---|---|---|---|---|---|---|---|
| SONG (A) | ARTIST (a) | SONG DATA (A) | 2003. 12.01 | 2004. 12.01 | — | — | ○ |
| SONG (B) | ARTIST (b) | SONG DATA (B) | 2003. 12.25 | 2004. 12.25 | — | ○ | — |
| SONG (C) | ARTIST (a) | SONG DATA (C) | 2004. 05.01 | 2005. 05.01 | — | — | — |
| SONG (D) | ARTIST (c) | SONG DATA (D) | 2004. 10.01 | 2005. 10.01 | — | — | — |
| SONG (E) | ARTIST (d) | SONG DATA (E) | 2004. 12.01 | 2005. 12.01 | ○ | — | — |
| SONG (F) | ARTIST (b) | SONG DATA (F) | 2004. 12.01 | 2005. 12.01 | ○ | — | — |

FIG. 14A

| SONG NAME | ARTIST NAME | SONG DATA |
|---|---|---|
| SONG (A) | ARTIST (a) | SONG DATA (A) |
| SONG (B) | ARTIST (b) | SONG DATA (B) |
| SONG (C) | ARTIST (a) | SONG DATA (C) |
| SONG (D) | ARTIST (c) | SONG DATA (D) |

FIG. 14B

| SONG NAME | ARTIST NAME | SONG DATA |
|---|---|---|
| SONG (B) | ARTIST (b) | SONG DATA (B) |
| SONG (C) | ARTIST (a) | SONG DATA (C) |
| SONG (D) | ARTIST (c) | SONG DATA (D) |

FIG. 14C

| SONG NAME | ARTIST NAME | SONG DATA |
|---|---|---|
| SONG (B) | ARTIST (b) | SONG DATA (B) |
| SONG (C) | ARTIST (a) | SONG DATA (C) |
| SONG (D) | ARTIST (c) | SONG DATA (D) |
| SONG (E) | ARTIST (d) | SONG DATA (E) |
| SONG (F) | ARTIST (b) | SONG DATA (F) |

GAME SYSTEM, TYPING GAME APPARATUS AND SERVER

CROSS-REFERENCE TO THE RELATED APPLICATION(S)

This application is based upon and claims a priority from prior Japanese Patent Applications No. 2005-018582 filed on Jan. 26, 2005, the entire contents of which are incorporated herein by reference.

BACKGROUND OF THE INVENTION

Field of the Invention

The present invention relates to a game system, a typing game apparatus, and a server in which the data with a definite usable term can be strictly managed.

Description of the Related Art

Nowadays, with the development of communication networks, large amounts of data can be transmitted. A data distribution system such as an on-demand distribution system has been developed in which the music data and the image data of movies are provided from the server to the customer via a communication network.

This data distribution system was described in JP-A-2004-134880, for example.

Along with the advancement of electronic information technology, various kinds of games have been developed, including a number of games using the communication networks.

In such a game using the communication network, the game data is often distributed through the communication network, like the music data and the image data.

For instance, a game played on the personal computer, or a network role-playing game in which a number of people participate, the game data is distributed via the communication network from the server to expand an area where the player can adventure, or add a new item.

On the other hand, in the data and program distributed through the communication network, the usable term may be defined for reasons of the producer of data or program.

For instance, in the music data, the usable term may be defined due to the intention of an artist, or the contract with a record company to which the artist belongs, and in the game data, the usable term may be defined due to the intention of a producer to increase the premium feeling of the game data.

In these cases, it is necessary to strictly manage the usable term of the distributed data to follow the contract with the artist or the record company, or increase the premium feeling of data.

SUMMARY OF THE INVENTION

However, in the case where the game data with the definite usable term is distributed to the game machine (so-called a business game machine), like a typing game apparatus, by the distribution method as described in JP-A-2004-134880, in the management on the server side, if the game data of which the usable term expired is simply deleted on the server side, the supply of the game data may be stopped, but the game data already distributed is not treated any more.

Also, when the usable term is managed on the game machine side, the clerk must manually delete the expired data for each game machine at the shop where the business game machines are installed, whereby the data management imposes a great burden on the shop.

Moreover, it is difficult for the distribution side of the game data to check whether or not the data of which the usable term has passed is deleted from the game machine. Accordingly, a problem that the usable term of the game data is strictly managed arises.

In view of the above-mentioned problem, it is an object of this invention to provide a typing game apparatus and a game system, particularly a game system that can manage the data with the usable term simply and securely, and a typing game apparatus and a server that are employed in the game system.

In order to accomplish the above object, according to a first aspect of the invention, there is provided a game system including a typing game apparatus having a game communication unit for communicating with a server and a game control unit for controlling a typing game, and a server having a server communication unit for communicating with the typing game apparatus, wherein the server includes a clock unit for clocking a time and date, a storage unit for storing game data with a definite usable term for use in the typing game, a time limit judgment unit for judging expired data that the usable term of game data passes, based on the clock unit and the usable term of data, and a command unit for issuing a deletion command for deleting the expired data based on the judgment result of the time limit judgment unit to the typing game apparatus, and the typing game apparatus includes data storage unit for storing the game data, and a data management unit for deleting the expired data from the data storage unit, based on the deletion command received by the game communication unit.

In a game system according to the first aspect of the invention, the game data has a definite usable term, and the server judges whether or not the game data is the expired data that the usable term of game data passes, based in a clock unit and the usable term of data, the game data being stored in a storage unit storing the game data for use in the typing game, and issues a deletion command for deleting the expired data to the typing game apparatus.

And the typing game apparatus has the data management unit to delete the expired data from the data storage unit, based on the received deletion command, if the expired data exists in the song data of the data storage unit storing the game data.

Thereby, in the game system, the time limit of the game data with definite usable term is strictly managed.

BRIEF DESCRIPTION OF THE DRAWINGS

These and other objects and advantages of the present invention will be more fully apparent from the following detailed description taken in conjunction with the accompanying drawings, in which:

FIG. 10 is an explanatory view of a data list creation process that is performed in the server according to this embodiment;

FIG. 12 is an explanatory view of a data list at the end of the data list creation process according to this embodiment;

FIGS. 14A to 14C are explanatory views of a song data storage area during execution of a term management process according to this embodiment;

FIGS. 18A and 18B show a display example of each liquid crystal display during execution of the typing game according to this embodiment, in which FIG. 18A shows a display example on the second liquid crystal display and FIG. 18B shows a display example on the first liquid crystal display.

DETAILED DESCRIPTION OF THE PREFERRED EMBODIMENTS

The embodiments of a game system according to the present invention will be described below with reference to the drawings.

First of all, the configuration of a game system according to an embodiment of the invention will be described below with reference to the drawings.

Figure 1:
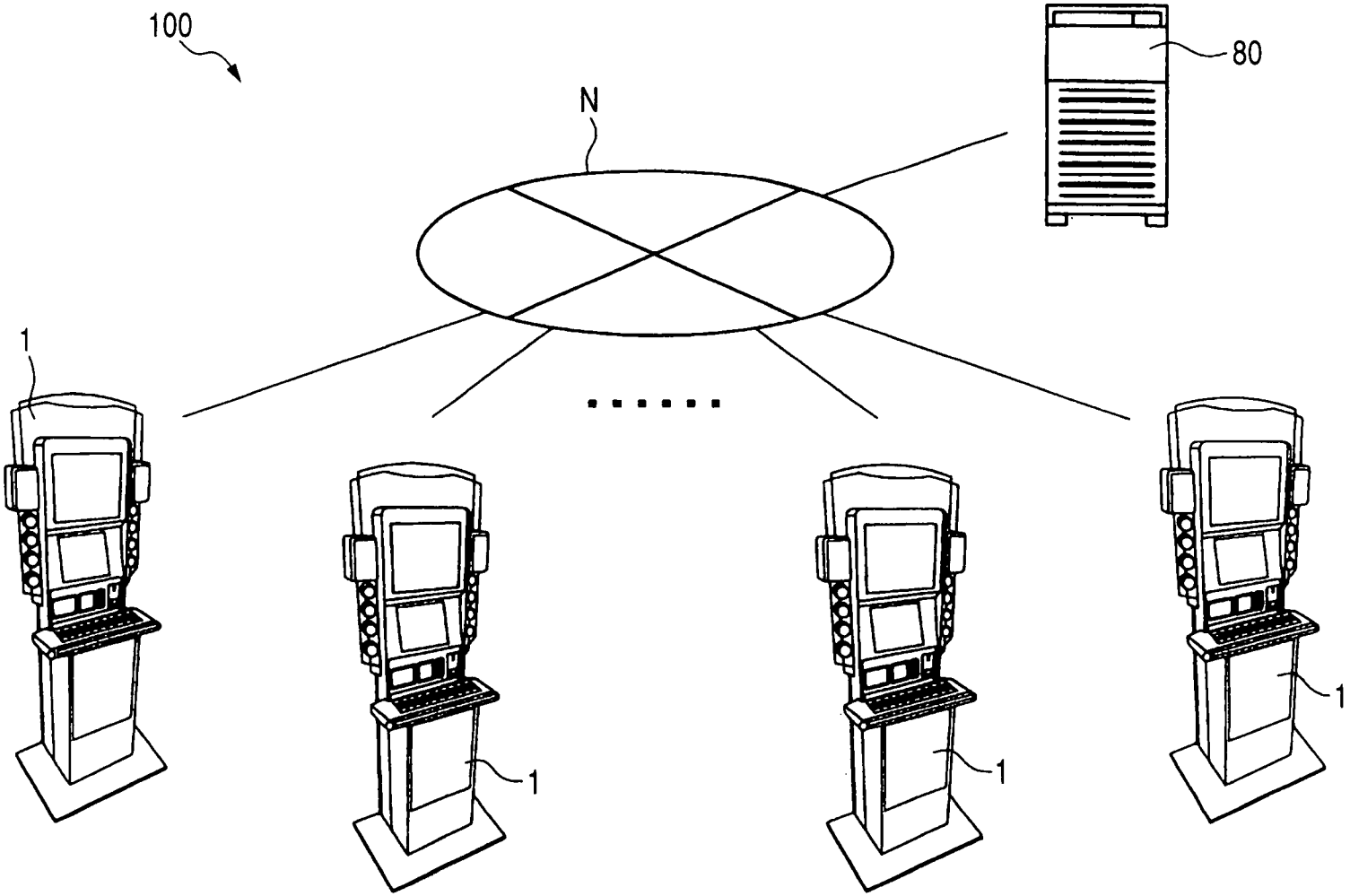
FIG. 1 is an explanatory view of a game system according to an embodiment of the invention.

FIG. 1 is an explanatory view showing a configuration example of the game system according to the embodiment.

The game system 100 of the invention is included of a number of typing game apparatuses 1 and a server 80. These typing game apparatuses 1 and the server 80 are connected via a network N to be operable as the game system 100 of the invention.

Herein, each typing game apparatus 1 has a game communication unit 25 for making wireless bi-directional communications with the server 80. On the other hand, the server 80 has a server communication unit 83 for transmitting or receiving data by wireless to or from each typing game apparatus 1.

In the game system 100 according to this embodiment, the typing game apparatuses 1 and the server 80 are connected by wireless via the network N to enable the wireless transmission and reception of data, the typing game apparatuses 1 and the server 80 are not necessarily connected by wireless but may be connected by wire to the network N.

Figure 2:
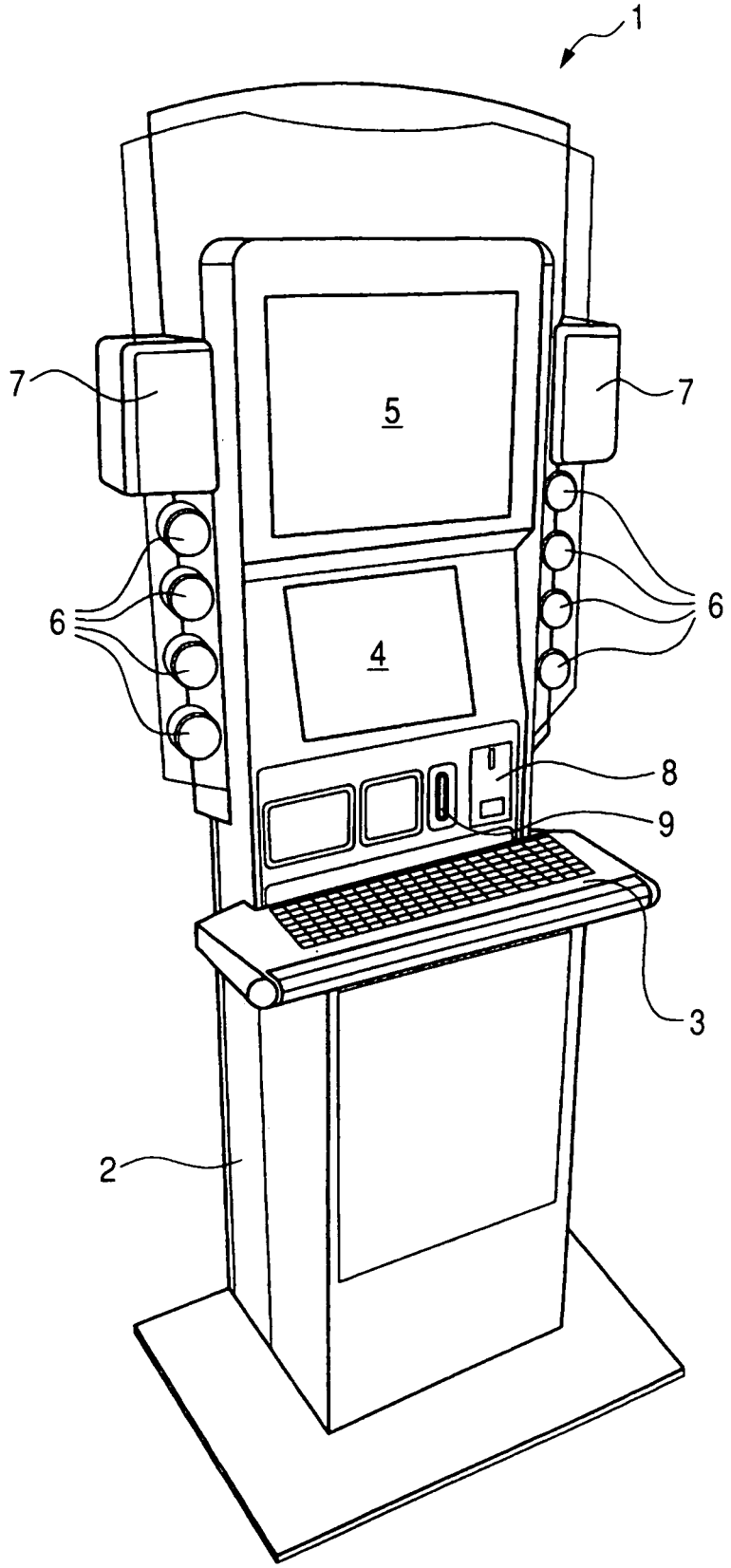
FIG. 2 is an external perspective view of a typing game apparatus constituting the game system according to this embodiment.
Figure 3:
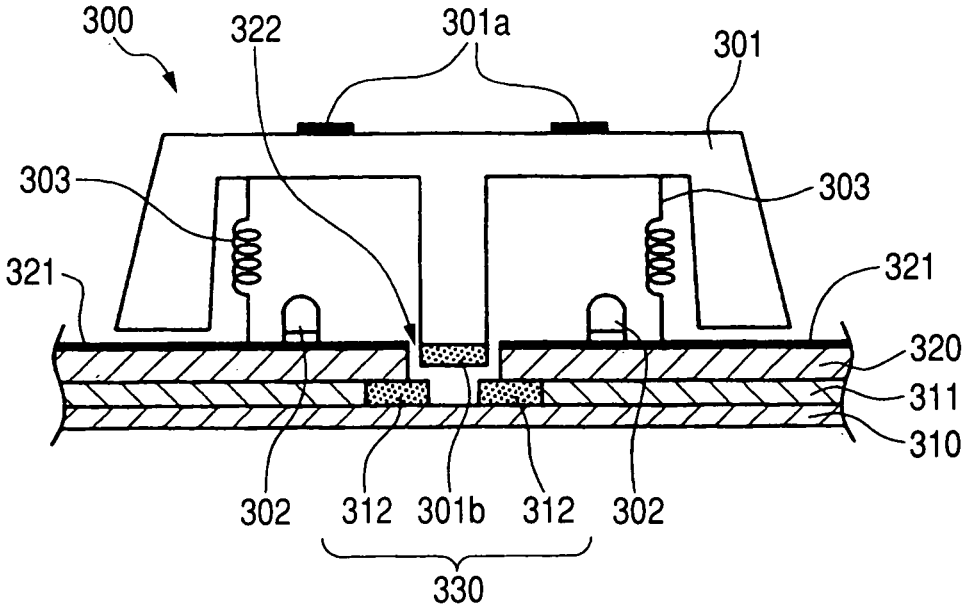
FIG. 3 is a cross-sectional view of one of the keys arranged on a keyboard in the typing game apparatus according to this embodiment.
Figure 4:
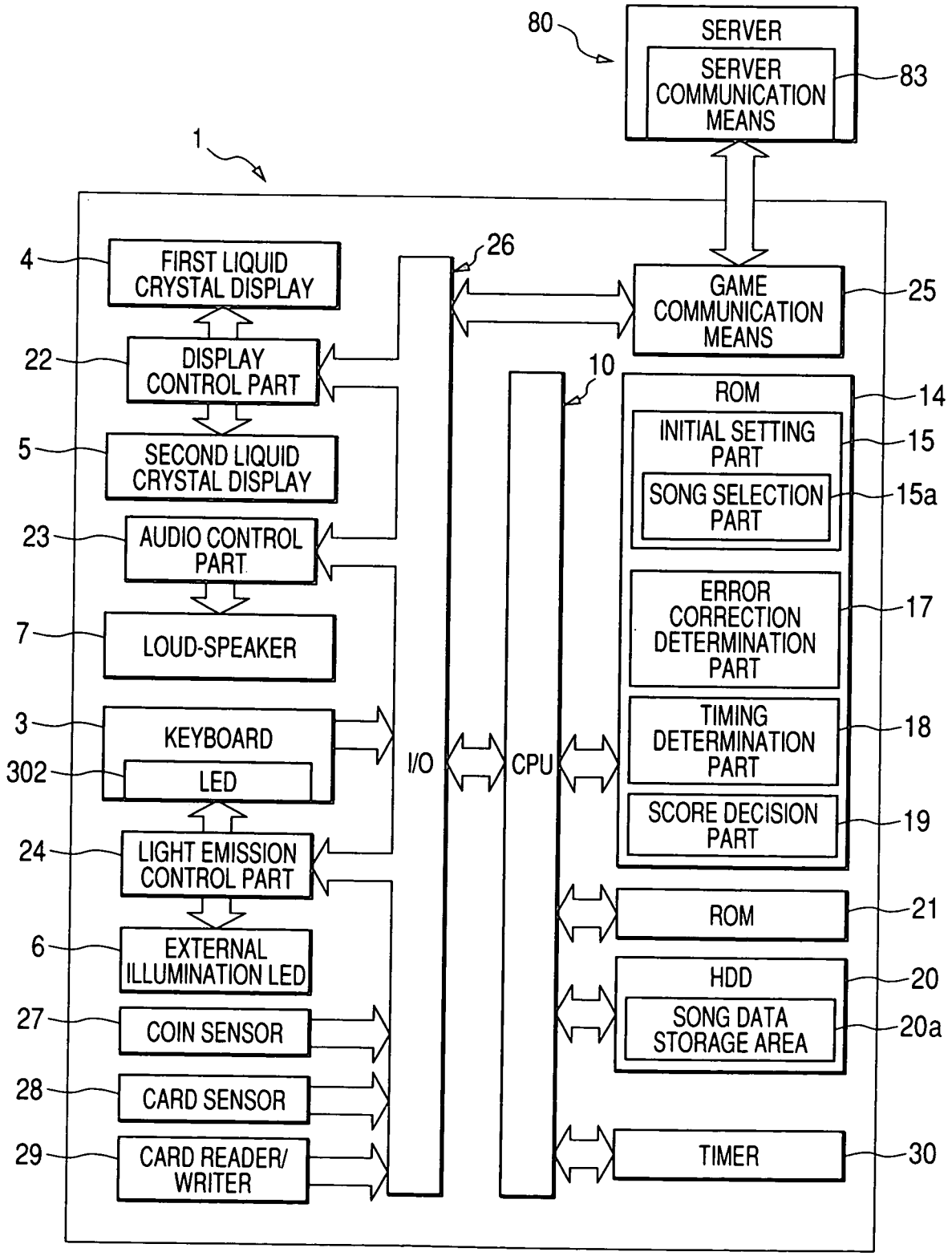
FIG. 4 is a block diagram showing a control system of the typing game apparatus according to this embodiment.
Figure 5:
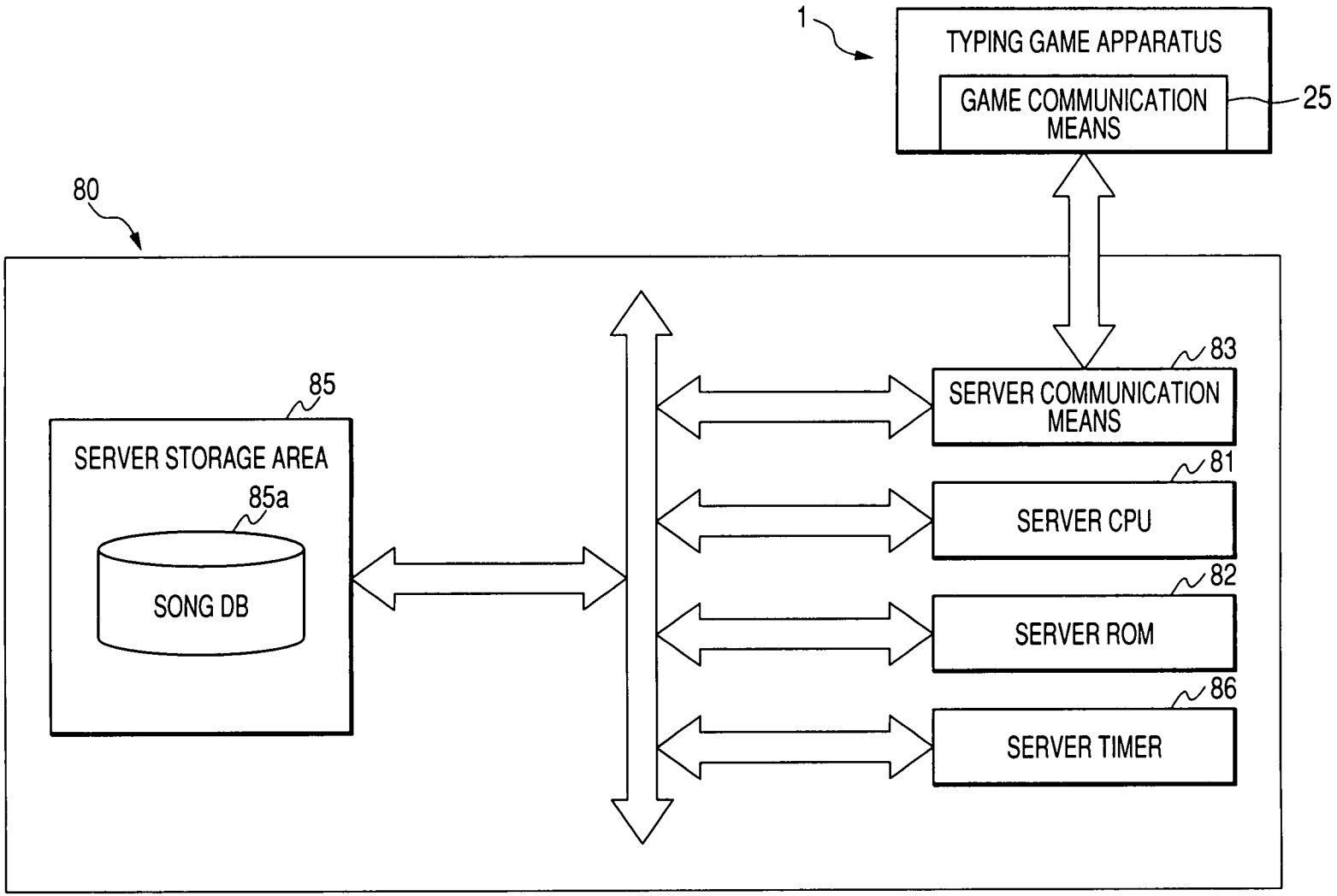
FIG. 5 is a block diagram showing a control system of a server according to this embodiment.

Referring to FIGS. 2 to 4, the typing game system according to this embodiment will be described below in detail.

First of all, referring to FIG. 2, the schematic configuration of the typing game apparatus 1 will be described below in detail. FIG. 2 is an external perspective view of the typing game apparatus 1.

In the typing game apparatus 1 according to this embodiment, a typing game is performed by inputting the lyrics of a song. That is, if the typing game is started, the performance data for accompaniment music of the song and the audio data for singing voice of a singer of the song are reproduced. Along with the progress of the performance data and the audio data of the song, the lyrics of the song are displayed for every phrase as a character string to be inputted by the player.

By inputting this displayed lyrics of one phrase from a keyboard 3, the typing game progresses. At the end of the song, the score of the typing game is calculated, based on the typing elements such as correctness of typing and input timing. In the typing game of the typing game apparatus 1, the player can scramble for the skills of typing, while enjoying the song played during the game.

As shown in FIG. 2, the typing game apparatus 1 according to this embodiment is composed of the keyboard 3, a first liquid crystal display 4 and a second liquid crystal display 5, which are disposed on a main body housing 2.

The first liquid crystal display 4 is disposed on the front side of the main body housing 2 in the typing game apparatus 1. The first liquid crystal display 4 is the so-called liquid crystal display, and slightly inclined backward from the front side of the main body housing 2.

The first liquid crystal display 4 displays the lyrics data of the song reproduced during execution of the typing game, and the indications for playing the typing game such as the input results that the player inputs employing the keyboard 3, and the associated score.

Namely, the first liquid crystal display 4 according to this embodiment corresponds to a first display unit of the invention.

The second liquid crystal display 5 is disposed upward of the first liquid crystal display 4 on the main body housing 2. This second liquid crystal display 5 is the so-called liquid crystal display, like the first liquid crystal display 4.

On the second liquid crystal display 5, the image for the reproduced song is displayed during execution of the typing game. For example, when the song of a certain artist is reproduced as the song, a promotion image (hereinafter referred to as PV) for the song of the artist is displayed.

A loud-speaker 7 is disposed on each of the left and right sides of the second liquid crystal display 5. The loud-speaker 7 is a device for pronouncing the song in the typing game apparatus 1. The song is pronounced based on the audio data and performance data of the song to be reproduced during execution of the typing game.

Also, four external illumination LEDs 6 are disposed on each of left and right sides of the main body housing 2. This external illumination LED 6 is the LED capable of lighting in full color, in which various illumination presentations are made in accordance with the song reproduced by the typing game apparatus 1. For example, the illumination presentations include a presentation for changing the illumination colors of a total of eight external illumination LEDs 6, a presentation for changing the illumination color in accordance with certain rules, and a presentation for turning on or off the external illumination LEDs 6.

On the other hand, a coin slot 8 and a card insertion opening 9 are disposed under the first liquid crystal display 4 disposed on the front side of the main body housing 2. The coin slot 8 collects a coin as the price to perform the typing game. Also, a coin sensor 27 is disposed inside the coin slot 8. When the coin sensor 27 senses the inputted coin, the typing game can be performed in the typing game apparatus 1.

Also, the card insertion opening 9 is a portion into which an IC chip built-in card (not shown) recording the game result of the typing game is inserted. A card sensor 28 and a card reader/writer 29 are disposed inside this card insertion opening 9. Accordingly, if the IC chip built-in card is inserted into the card insertion opening 9, the card sensor 28 senses the IC chip built-in card, and the card reader/writer 29 reads or writes the game result of the typing game from or into the IC chip built-in card.

The keyboard 3 is disposed to extend on the front side of the main body housing 2. This keyboard 3 is means for inputting the keys corresponding to characters, symbols and numbers, with an arrangement of a plurality of keys 300 including "A to Z", "A to N (Japanese characters)", "0 to 9", a period, a comma and a decision key. The keyboard 3 is also a command unit for selecting or deciding the song or character species, or starting to execute the typing game.

Accordingly, when the typing game is executed in the typing game apparatus 1, the game progresses by inputting the keys 300 corresponding to the character string (one phrase of the lyrics) displayed on the first liquid crystal display 4.

Herein, the configuration of the keyboard 3 will be described below. FIG. 3 is a schematic cross-sectional view, partially cut away, showing one of the keys 300 provided on the keyboard 3.

As shown in FIG. 3, each key 300 is composed of a base plate 310, a switch circuit plate 311, an emission circuit plate 320, a key top 301 and a biasing mechanism 303.

In this respect, the switch circuit plate 311 laid on the base plate 310 is provided with a pair of electrodes 312 disposed directly under and around the center of the key top 301.

Also, the emission circuit plate 320 laid on the switch circuit plate 311 is provided with an opening portion 322 for exposing the pair of electrodes 312, and the LEDs 302 capable of lighting in full color are provided on the periphery of the opening portion 322.

Also, the biasing mechanisms 303 are provided between the emission circuit plate 320 and the key top 301 to bias the key top 301 against the switch circuit plate 311. Further, an electrode 301*b* juts out to the switch circuit plate 311 near the center of the key top 301. Accordingly, if the key top 301 is depressed, the electrode 301*b* jutting out of the key top 301 is contacted with one pair of electrodes 312 provided on the switch circuit plate 311. Therefore, an operation of depressing the key top 301 is passed as an electrical signal through the switch circuit plate 311. Hence, these three electrodes 301*b*, 312 make up the key switch 330.

The biasing mechanism 303 may be composed of an elastic body alone, or an elastic body and a bridge mechanism, or any other unit.

Also, the key top 301 is formed of a translucent material (e.g., transparent acrylic, transparent plastic, etc.), and the key information 301*a* of characters, numbers and symbols is printed in black on a planar portion on the opposite side of the switch circuit plate 311. Further, the surface of the emission circuit plate 320 on the side of the key top 301 is also printed in black.

Accordingly, the translucent key top 301 is reflected in black that is the surface color of the emission circuit plate 320, while the LEDs 302 are turned off, whereby the key information 301*a* printed in black is difficult to recognize on the key top 301 reflected in black.

On the other hand, while the LEDs 302 are turned on, the translucent key top 301 is reflected in a color in which the LEDs 302 is lighted, whereby the key information 301*a* printed in black is easy to recognize on the key top 301 reflected in the color.

The key switch 330 within the key 300 is connected to an oscillation circuit, not shown, on the keyboard 3. The oscillation circuit is connected via an interface unit 26 (hereinafter referred to as I/O) to a CPU 10 of the typing game apparatus 1. Accordingly, the depressed key 300 can be specified by sending an electrical signal from the key switch 330 of the depressed key 300 via this oscillation circuit to the CPU 10. The oscillation circuit is mounted on the switch circuit plate 311.

Also, the LEDs 302 within the key 300 are connected to an emission control part 24 in the keyboard 3. Further, the emission control part 24 is connected via the I/O 26 to the CPU 10. Accordingly, the CPU 10 enables the LEDs 302 within the key 300, to light up in a specified color via the emission control part 24.

Though one key 300 has been described in FIG. 3, other keys 300 arranged on the keyboard 3 have the same configuration and function.

A control system of the typing game apparatus 1 will be described below in detail with reference to the drawings. FIG. 4 is a block diagram of the control system for the typing game apparatus 1.

As shown in FIG. 4, the control system of the typing game apparatus 1 includes the CPU 10 for governing various controls for a play processing operation in the typing game apparatus 1, and the peripheral devices (actuators) electrically connected to the CPU 10.

The CPU 10 is a central processing unit for performing the arithmetical operation in accordance with various kinds of command. The I/O 26 is a connection for electrically connecting the keyboard 3, the first liquid crystal display 4, the second liquid crystal display 5 and the loud-speakers 7 to the CPU 10 directly or indirectly. A ROM 14 is a non-volatile, read-only memory storing an arithmetical program for performing the operation in accordance with a flowchart as will be described later. And a RAM 21 is a volatile read or write memory for temporarily storing the data to be employed when the CPU 10 executes the program, and temporarily storing the song data stored in an HDD 20.

The HDD 20 is a storage device for storing the song data to be employed when the typing game is performed in the typing game apparatus 1. The HDD 20 is formed with a song data storage area 20*a* storing plural pieces of song data.

Figure 6:
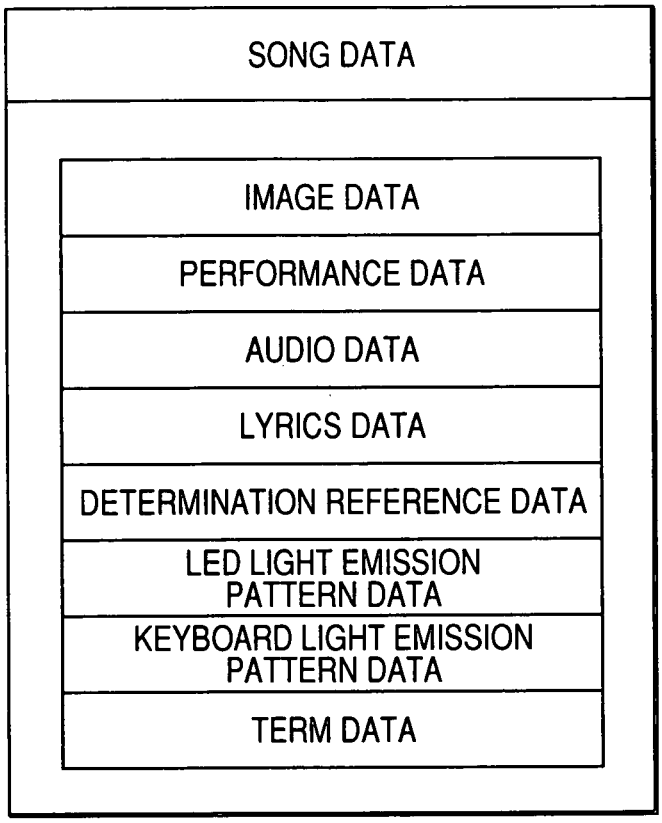
FIG. 6 is an explanatory view of song data stored in the typing game apparatus and the server according to this embodiment.

Herein, the song data stored in the HDD 20 will be described below in detail with reference to the drawings. FIG. 6 is an explanatory view showing the configuration of song data.

As shown in FIG. 6, the song data employed in the typing game apparatus 1 is composed of image data, performance data, audio data, lyrics data, determination reference data, LED light emission pattern data, keyboard light emission pattern data, and term data.

In the typing game apparatus 1 according to this embodiment, the typing game is performed by inputting the lyrics of the song, while reproducing the song of a song that the artist sings. The above data making up the song data accord with the song.

That is, the image data making up the song data is the data of PV image for the artist corresponding to the song, the performance data is the music data accompanied by instruments in the song, and the audio data is the data of singing voice with which the artist sings the song.

The lyrics data making up the song data is the text data of the lyrics corresponding to the song, and employed to display the lyrics for every phrase on the first liquid crystal display 4 in performing the typing game.

And the determination reference data making up the song data is the reference data for determining whether the key 300 inputted by the player is correct or not, and whether the input timing is correct or not, in performing the typing game employing the song data.

Accordingly, when the player makes the typing with reference to the determination reference data, a high score is granted. On the other hand, if the key 300 inputted by the player is different from the key 300 defined in the determination reference data (so-called a mismatch), or if the key input timing is too late for the progress of song, in other lyrics, if there is a difference from the reference of determination reference data, the high score can not be obtained at the end of the typing game.

The LED light emission pattern data and keyboard light emission pattern data making up the song data is the presentation data in which the form of illumination presentation for the typing game apparatus 1 is defined in performing the typing game employing the song data.

That is, the LED light emission pattern data is the data of light emission pattern of the external illumination LEDs 6 emitting light along with the progress of song, during execution of the typing game. Accordingly, the light emission form of the external illumination LEDs 6 in performing the typing game employing the song data is defined based on the LED light emission pattern data, whereby the light emission form (e.g., light emission color, turning on or off a light, etc.) of each of eight external illumination LEDs 6 is controlled via the emission control part 24.

And the keyboard light emission pattern data is the data of light emission pattern of the LEDs 302 arranged for every key 300 making up the keyboard 3. Accordingly, the light emission form of the LEDs 302 for each key 300 making up the keyboard 3 is controlled by the emission control part 24, based on the keyboard light emission pattern data.

The keyboard 3 has a variety of light emission patterns, including a light emission pattern of assisting the key input by sequentially lighting the keys 300 to be inputted in a different light emission color from the light emission color of the entire keyboard 3 for the beginners of the typing game, and a pattern of changing the light emission color of all the keys 300 arranged on the keyboard 3 in accordance with the image of song.

And the term data is the data of usable term for the song data, consisting of two date data of the date when the song data is usable (use start day) and the date when the song data is unusable (use end day). The date data of the use start day for the song data is called the term start data, and the date data of the use end day for the song data is called the end term data. The term data is employed for management of the usable term for each song data in the server 80.

Returning to FIG. 4, the control system of the typing game apparatus 1 will be described below.

The game communication unit 25 is a device for converting a signal to be sent out by the typing game apparatus 1 into a transmittable signal in the communication format through the telephone line or LAN cable to transmit the signal to the outside, and receiving a signal and converting it into the signal in the readable format by the typing game apparatus 1. And the game communication unit 25 is connected by wireless to the network N and connected via the network N to a server communication unit 83 of the server 80.

A display control part 22 is connected via the I/O 26 to the CPU 10, and is employed to control the display contents of the first liquid crystal display 4 and the second liquid crystal display 5 in accordance with the arithmetical operation results of the CPU 10. That is, the display control part 22 displays the lyrics data making up the song data for every phrase on the first liquid crystal display 4, when the typing game is performed. Also, the display control part 22 is employed to display the characters corresponding to the input contents on the first liquid crystal display 4, based on the input result of the keyboard 3.

And the display control part 22 is also employed to display a variety of presentation images on the second liquid crystal display 5. That is, the display control part 22 is employed to display the PV image that is the image data of the song during execution of the typing game.

An audio control part 23 is connected via the I/O 26 to the CPU 10, and to the loud-speakers 7. When the typing game is performed, the song data is read out, and the performance data and the audio data making up the song data are converted into audio signal by the audio control part 23, and outputted from the loud-speakers 7.

And the emission control part 24 is connected via the I/O 26 to the CPU 10 and connected to the external illumination LEDs 6 and the LEDs 302 within each key 300 disposed on the keyboard 3. The emission control part 24 is employed to control the light emission form of each of the external illumination LED 6 and the LEDs 302, based on the LED light emission pattern data and the keyboard light emission pattern data making up the song data, during execution of the typing game, if the song data is read out.

A coin sensor 27 is a sensor for sensing a coin for use as the compensation to perform the typing game. The coin sensor 27 is disposed inside the coin slot 8, and connected via the I/O 26 to the CPU 10. Accordingly, the coin sensor 27 issues a coin input signal to the CPU 10, based on the input of coin through the coin slot 8. The CPU 10 permits execution of the typing game, upon sensing the coin input signals corresponding to a predetermined number of coins.

A card sensor 28 is a sensor for sensing whether or not the IC chip built-in card is inserted into the card insertion opening 9, and a card reader/writer 29 is a device for reading or writing data from or into an IC chip disposed in the IC chip built-in card. The card sensor 28 and the card reader/writer 29 are disposed inside the card insertion opening 9, and connected via the I/O 26 to the CPU 10. If the card sensor 28 senses that the IC chip built-in card is inserted, the CPU 10 reads data from the IC chip via the card reader/writer 29, or writes data into the IC chip.

A timer 30 is a clock unit connected to the CPU 10. And the timer 30 is referred to in judging the passage of a predetermined time.

Herein, each function of the ROM 14 for use in performing the flowchart will be detailed below. The ROM 14 has an initial setting part 15, an error correction determination part 17, a timing determination part 18 and a score decision part 19.

The initial setting part 15 has a song selection part 15*a*, and is employed to set up the contents of the game at the start of the game. That is, in this embodiment, the initial setting part 15 is employed to select the song data for use in the typing game or change the game settings (e.g., degree of difficulty) of the typing game from a plurality of pieces of song data stored in the song data storage area 20*a*.

The song selection part 15*a* allows the player to select the song name, and is employed to read the song data corresponding to the song name selected by the player from the HDD 20, and temporarily store the song data in the RAM 21. More specifically, the CPU 10 displays a song selection screen on the first liquid crystal display 4, employing the song selection part 15*a*. A plurality of artist names and titles of the songs of the artists are displayed on the song selection screen. Accordingly, if the player selects the desired song employing the keyboard 3, the song data corresponding to the desired song is read from the HDD 20 and stored in the RAM 21. Thus, plural pieces of the song data stored in the RAM 21 are sequentially reproduced, and displayed on the first liquid crystal display 4 and the second liquid crystal display 5 and outputted from the loud-speaker 7, whereby the typing game based on the desired song is executed.

The error correction determination part 17 is employed to determine whether or not the key input is successful for the input character of interest at present by comparing the input information corresponding to the characters making up the character string displayed on the first liquid crystal display 4 with the determination reference data of the song.

The timing determination part 18 is employed to determine whether or not the key input is made along with the progress of the song, based on the determination reference data. That is, the timing determination part 18 is employed to determine whether or not the key input is made at the timing almost synchronous with the singing voice of the artist in the song.

The score decision part 19 is employed to decide the game score of the player, based on the determination results of the error correction determination part 17 and the timing determination part 18. More specifically, the score decision part 19 is employed to decide the game score based on the correction of errors (presence or absence of a so-called mismatch) of the input key and errors in the input timing of keys during the typing game.

Next, the server 80 that distributes the song data to the typing game apparatus 1 at any time and issues a command for managing the song data of the typing game apparatus 1 will be described below.

The server 80 according to this embodiment is included of a sever CPU 81, a server ROM 82, a server communication unit 83, a server storage area 85, and a server timer 86.

The server CPU 81 is a central processing unit for performing the control program to make various kinds of control for the server 80. Accordingly, the server CPU 81 executes a data list creation program stored in the server ROM 82 or a communication program for transmitting or receiving the data or signal to or from each typing game apparatus 1 constituting the game system 100.

The server ROM 82 is a non-volatile read-only memory for storing the control programs for the server CPU 81 to make various kinds of control. Accordingly, the server ROM 82 stores various programs such as a data list creation program for creating the data list of song data from a song DB 85*a* and a communication program.

The server communication unit 83 is a communication unit for enabling the server 80 to make the bi-directional communication with the typing game apparatus 1 via the network N. That is, the server communication unit 83 is a device for converting data transmitted by the server 80 into a transmittable signal in the communication format through the telephone line or LAN cable to transmit the signal to the outside, and receiving a signal transmitted from the typing game apparatus 1 and converting it into the signal readable by the server 80. And the server communication unit 83 is connected by wireless via the network N to the game communication unit 25 of the typing game apparatus 1.

The server storage area 85 is a storage unit for storing various kinds of data for use in the server 80, in which the storage contents can be added or deleted. This server storage area 85 is a storage unit for temporarily storing various kinds of arithmetical results in performing the control program of the server 80.

The server storage area 85 stores the song data used in each typing game apparatus 1 constituting the game system 100 (hereinafter referred to as in-use song data), namely, the management data based on the storage contents of the song data storage area 20*a*, associated with the identification information of each typing game apparatus 1. Thereby, the server 80 can grasp the use situation of song data for all the typing game apparatuses 1 constituting the game system 100, and make the data management of song data for each typing game apparatus 1, based on the management data.

Moreover, the server storage area 85 is formed with the song DB 85*a*. The song DB 85*a* memorizes plural pieces of song data, in which song data can be added or deleted. The server 80 distributes the song data stored in the song DB 85*a* to the typing game apparatus 1 via the network N.

Accordingly, the new song data can be distributed to the typing game apparatus 1 by adding to the song DB 85*a*, whereby the player can enjoy the new song with the typing game in the typing game apparatus.

The server timer 86 is a clock unit for clocking a time and date. And the server timer 86 is connected to the server CPU 81, and employed to create the data list based on the song data within the song DB 85*a*.

Specifically, the server timer is employed to judge the song data added most lately at present (hereinafter referred to as the latest song data) to the song DB 85*a* by referring to the current time of the server timer 86 in creating the data list.

Also, the server timer 86 is employed to specify the song data of which the usable term has expired (hereinafter referred to as the expired data) and the song data of which the usable term is about to expire (hereinafter referred to as the required warning data) by referring to the current time of the server timer 86 and comparing it with the term data of each song data.

It is desirable that the server timer 86 is always adjusted to the correct time, like an electric wave clock having a function of automatically correcting for the time error.

Figure 7:
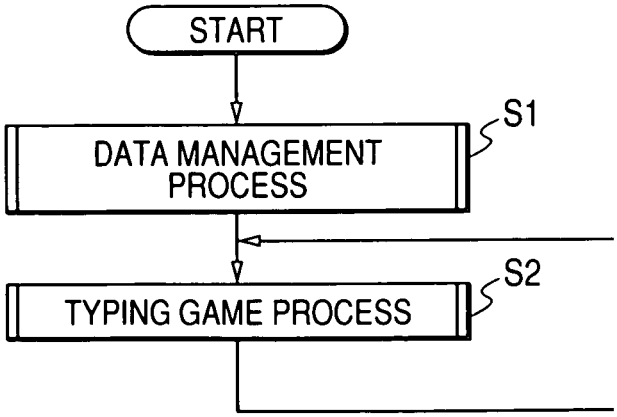
FIG. 7 is a flowchart of a main control program for the typing game apparatus according to this embodiment.

Next, the operation of the typing game apparatus 1 will be described below with reference to the drawings. Referring firstly to FIG. 7, a main control program of the typing game apparatus 1 will be described below in detail. FIG. 7 is a flowchart of the main control program for the typing game apparatus 1.

In the typing game apparatus 1 according to this embodiment as shown in FIG. 7, if the power is turned on, a data management process (S1) is performed. The data management process (S1) is the process of deleting the song data stored in the song data storage area 20*a* of the typing game apparatus due to the expiration of usable term, adding the latest song data for the server 80 to the song data storage area 20*a*, and making a warning for the song data of which the usable term is about to expire. This data management process (S1) will be described later in detail with reference to the drawings, and is not described here.

After the end of the data management process (S1), the typing game apparatus 1 transfers to a typing game process (S2). This typing game process (S2) is the process for performing the above-mentioned typing game. The typing game process will be described later in detail with reference to the drawings, and is not described here.

After the end of the typing game process (S2), that is, once the typing game is performed, the operation returns to S2 to accept the execution of the typing game.

Herein, each process of the main control program for the typing game apparatus 1 will be described below in detail with reference to the drawings.

Figure 8:
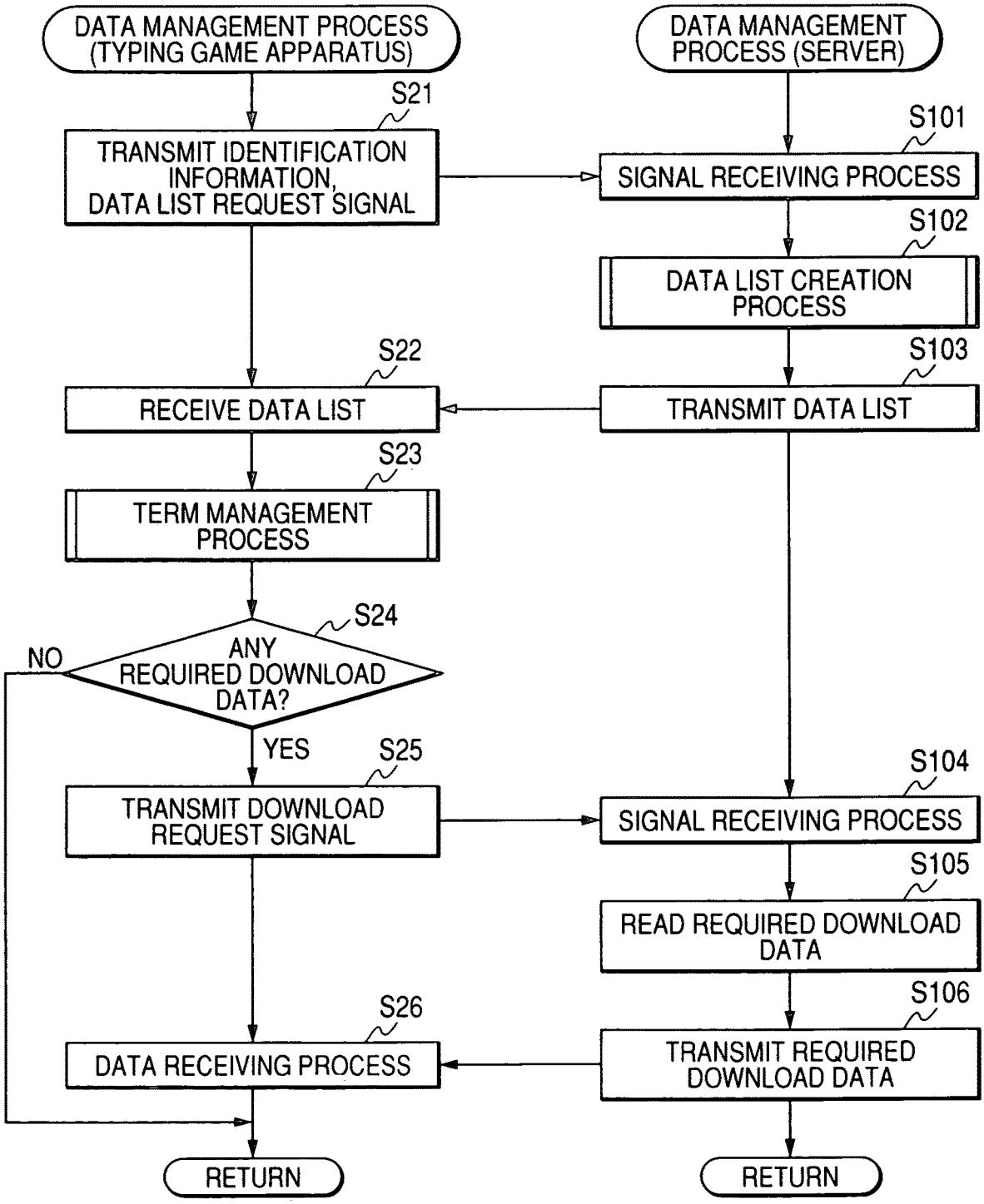
FIG. 8 is a flowchart of a data management processing program for the game system according to this embodiment.

First of all, referring to FIGS. 8 to 15, the data management process (S1) that is firstly performed when the main control program of the typing game apparatus 1 is performed will be described in detail. FIG. 8 is a flowchart of the data management processing program.

If the power of the typing game apparatus 1 is turned on, and the data management process (S1) is started, the CPU 10 firstly transmits a data list request signal of requesting the data list corresponding to the typing game apparatus 1, together with the identification information indicating the typing game apparatus 1, to the server 80 (S21).

On the other hand, the server CPU 81 receives the data list request signal and identification information transmitted from the typing game apparatus 1, and stores the received identification information in the server storage area 85 (S101). Then, the operation goes to a data list creation process (S102).

Figure 9:
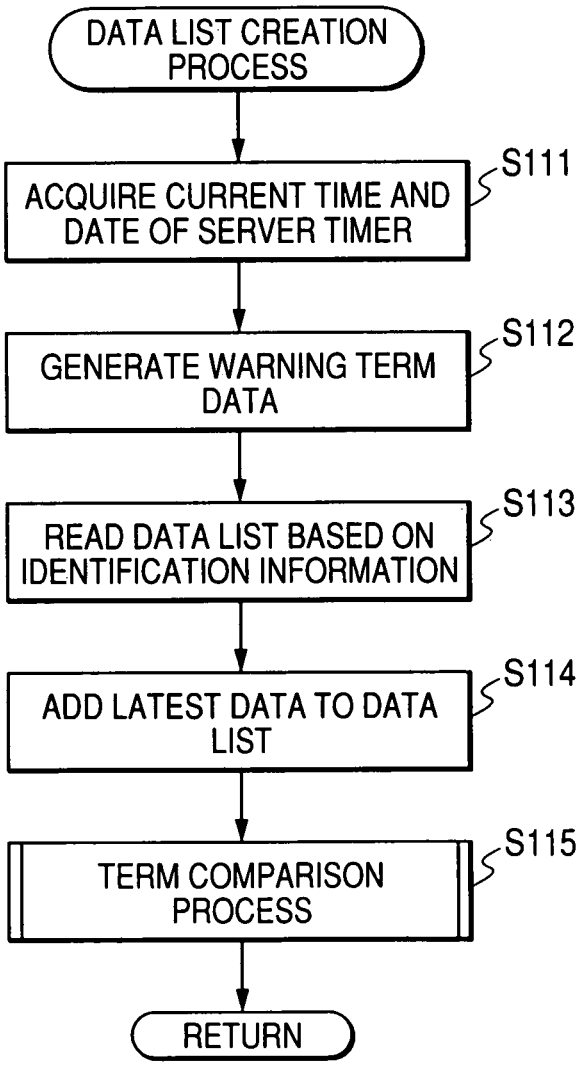
FIG. 9 is a flowchart of a data list creation processing program for the server according to this embodiment.

The data list creation process (S102) will be described below in detail with reference to the drawings. FIG. 9 is a flowchart of a data list creation processing program. If the operation goes to the data list creation process (S102), the server CPU 81 firstly acquires the time data (hereinafter referred to as the current time and date data) of current time and date from the server timer 86, and stores it in the server storage area 85 (S111). Thereafter, the warning term data used when the song data specifies the required warning data based on the timer data stored in the server storage area 85 is generated, and stored in the server storage area 85 (S112).

The processing for generating the warning term data (S111, S112) will be described below by employing a specific example. Herein, it is supposed that the current time and date indicated by the server timer 86 is Dec. 1, 2004, AM 10. Accordingly, the current time and date data of "2004.12.01, AM 10:00" is stored in the server storage area 85 at step S111.

And at step 112, the warning term data is generated based on this current time and date data. The warning term data is employed to specify the required warning data, namely, the song data of which the usable term is about to expire. In this embodiment, it is supposed that the usable term about to expire is the term of one month before the date when the song data is unusable (use end date). The song data of which the use end date occurs within the term defined by the time and date indicated by the current time and date data, and the time and date indicated by the warning term data (i.e., within one month from the current time and date) is judged as the required warning data. Accordingly, the warning term data is the data indicating the time and date one month after the time and date indicated by the current time and date data stored in the server storage area 85.

In the specific example as previously described, the data of "2005.01.01" one month after the current time and date "2004.12.01 AM10:00" is stored as the warning term data in the server storage area 85 (S112).

The server CPU 81 stores the current time and date data and the warning term data in the server storage area 85. Then the operation goes to S113.

At S113, the typing game apparatus 1 originating a data list request signal is specified based on the identification information stored in the server storage area 85, and an in-use song data list consisting of pieces of the in-use song data stored in the song data storage area 20*a* of the typing game apparatus 1 is read out from the management data of the typing game apparatus 1.

For example, when the typing game apparatus 1 in which song data (A), song data (B), song data (C) and song data (D) are stored in the song data storage area 20*a* originates the data list request signal, the in-use song data list consisting of song (A), song (B), song (C) and song (D) is read out, as shown in FIG. 10.

At S114, the latest song data list consisting of the latest song data is added to the in-use song data list. The latest song data is specified by comparing the current time and date data and the term start data of each song data.

That is, under the conditions that the term start data of song data indicates the time and date in the past before the current time and date data, and the song data has the term start data nearest to the current time and date data, all the song data stored in the song DB 85*a* are retrieved to specify the latest song data.

A latest song data list is created based on the latest song data specified in this way. For example, when song data (E) and song data (F) are added to the song DB 85*a* on Dec. 1, 2004, the song data (E) and the song data (F) correspond to the latest song data, and the latest song data list is created based on these song data (see a central view in FIG. 10).

The latest song data list created in the above way is added to the in-use song data list read out at step S113, whereby the data list consists of the in-use song data and the latest song data. In the previous example, the song data list consists of song data (A), song data (B), song data (C), song data (D), song data (E) and song data (F).

At S115, a term comparison process of comparing the term data of the in-use song data and the term data of the latest song data that make up the data list with the current time and date data and the warning term data stored in the server storage area 85 is performed.

Figure 11:
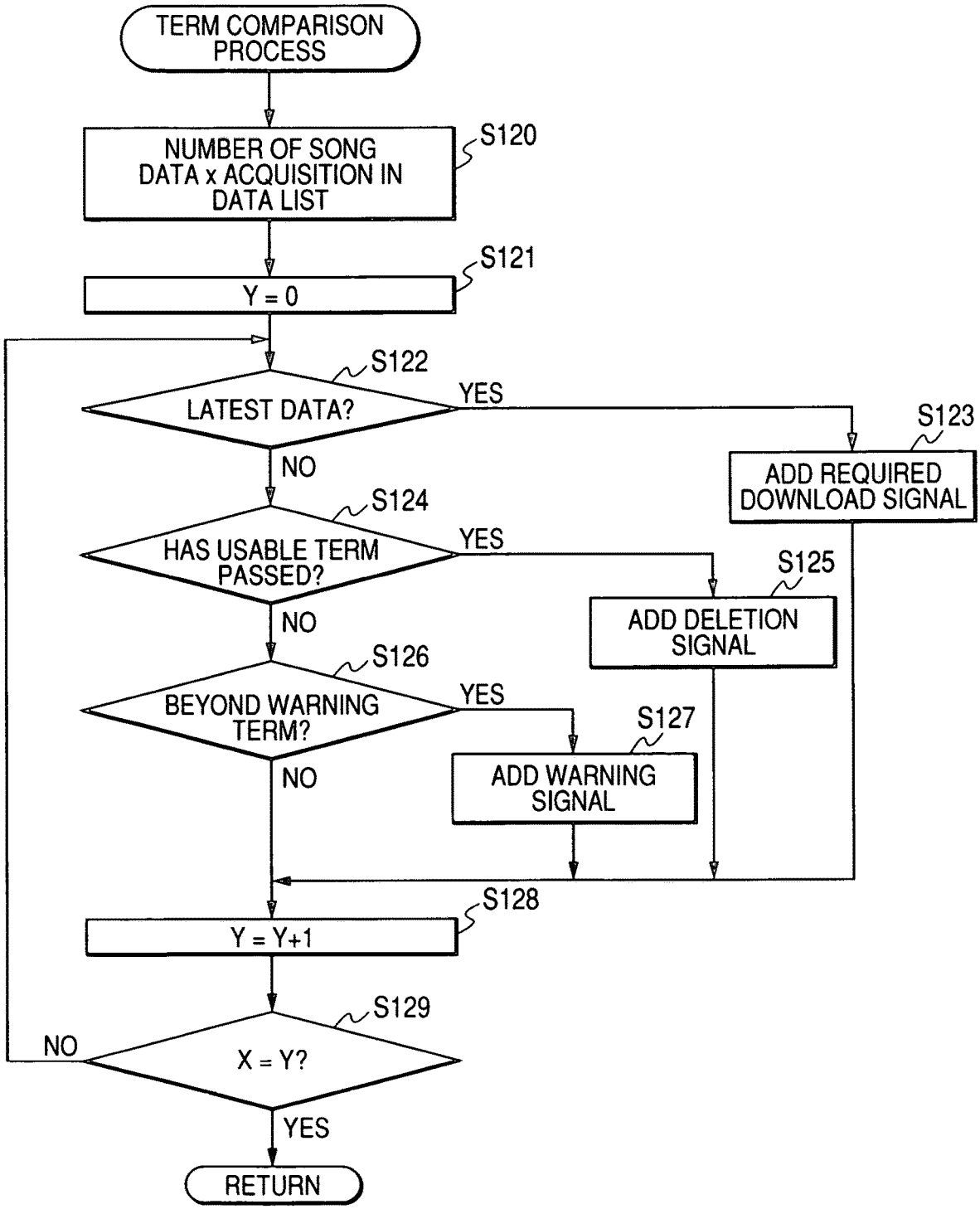
FIG. 11 is a flowchart of a term comparison processing program for the server according to this embodiment.

Referring to FIGS. 11 and 12, the term comparison process will be described below in detail. FIG. 11 is a flowchart of a term comparison processing program.

If the term comparison process is started at S115, the server CPU 81 firstly acquires the number X of song data in the data list, and stores it in the server storage area 85 (S120) In the previous example, the data list consists of six pieces of song data, including song data (A) to (F), whereby "X=6".

And a variable Y indicating the number of pieces of song data ending the term comparison is initialized to "0" (S121). Then, the operation goes to S122.

At S122, it is judged whether or not the song data subject to the term comparison process at present (hereinafter referred to as object song data) is the latest song data. Accordingly, the server CPU 81 makes a judgment as to whether or not the object song data is the song data added at S114.

If the object song data is the latest song data (S122: YES), the operation goes to S123, where a required download signal requesting the distribution of object song data to the typing game apparatus 1 is added to the data list, associated with the object song data. After the required download signal is added to the data list, the operation goes to S128.

On the other hand, if the object song data is not the latest song data (S122: NO), the operation goes to S124.

At S124, it is judged whether or not the object song data is expired data, namely, the current time and date exceeds the end term of data. Accordingly, the server CPU 81 reads the current time and date data from the server storage area 85, and compares it with the end term data of the object song data.

If the time and date indicated by the current time and date data exceeds the use end date indicated by the end term data, or the time and date indicated by the current time and date is the same with the time and date indicated by the end term data, it is judged that the object song data is expired data (S124: YES), because the usable term of object song data is ended. Then, the operation goes to S125. And at S125, a deletion signal of deleting the object song data from the song data storage area 20*a* of the typing game apparatus 1 is added to the data list, associated with the object song data. After the deletion signal is added to the data list, the operation goes to S128.

On the other hand, if the current time and date does not exceed the use end date of the end term data, it is judged that the object song data is not expired data (S124: NO), and the operation goes to S126.

At S126, the server CPU 81 judges whether or not the object song data is the required warning data. That is, the server CPU 81 makes a judgment as to whether or not the object song data is expired within one month from now. Accordingly, the server CPU 81 reads the warning term data from the server storage area 85, and compares it with the end term data of object song data.

If the use end date indicated by the end term data is before the time and date indicated by the warning term data, it is judged that the object song data is required warning data (S126: YES). Then, the operation goes to S127.

Since the object song data judged as expired data is already processed at S124 as previously described, the object song data to be judged at S126 is the song data usable at present, except for the latest song data. Accordingly, in the cases where the use end date is before the time and date indicated by the warning term data, the period up to the use end date is within one month.

And at S127, a warning signal indicating that the "usable term of object song data is about to expire" is displayed on the first liquid crystal display 4 of the typing game apparatus 1, and added to the data list, associated with the object song data. After the warning signal is added to the data list, the operation goes to S128.

On the other hand, if the use end date indicated by the end term data is later than the time and date indicated by the warning term data, it is judged that the object song data is not required warning data (S126: NO). Then, the operation goes to S128.

At S128, the variable Y indicating the number of song data ending the term comparison is incremented by 1, and stored in the server storage area 85, because the term comparison of the object song data is ended through the steps S122 to S127. And at S129, it is judged whether or not the variable X is equal to the variable Y. That is, it is judged whether or not the term comparison is made for all the song data making up the data list.

If the term comparison for all the song data is ended, namely, the variable X is equal to the variable Y (S129: YES), the term comparison process (S115) is ended. And the created data list is stored in the server storage area 85, and the data list creation process (S102) is ended.

On the other hand, if the term comparison for all the song data is not ended, namely, the variable X is not equal to the variable Y (S129: NO), the operation returns to S122, where the object song data is changed to another song data, and the term comparison for the new object song data is made.

In an example of the data list consisting of song data (A) to (F), the term comparison for the song data is made till the variable Y indicating the number of song data ending the term comparison becomes 6 that is the number "X" of song data making up the data list.

Referring to FIG. 12, the term comparison process will be described below, based on the example of the data list consisting of song data (A) to (F) as previously described. FIG. 12 is an explanatory view of the data list at the end of the term comparison process.

In this explanation, it is supposed that the current time and date is Dec. 1, 2004, the current time and date data is "2004.12.01 AM10:00", and the warning term data is "2005.01.01", based on the specific example as previously described.

Since the song data (E) and the song data (F) are added as the latest data to the data list (S114), as shown in FIG. 12, the song data (E) and the song data (F) as the required download data are associated with the required download signal (S123).

Since the song data (A) is not the latest song data (S122: NO), the operation goes to S124 to judge whether or not the song data is expired data. Herein, the use end date indicated by the end term data "2004.12.01" for the song data (A) is Dec. 1, 2004, and the current time and date is Dec. 1, 2004. Accordingly, the song data (A) corresponds to the expired data (S124: YES), whereby the song data (A) is associated with the deletion signal.

Also, if the term comparison process is made for the song data (B), the song data (B) is not the latest song data (S122: NO), and the operation goes to S124, where it is judged whether or not the song data (B) is the expired data. Herein, the end term data of the song data (B) is "Dec. 25, 2004", and does not exceed the usable term at present. Accordingly, the song data (B) does not correspond to the expired data (S124: NO), and the operation goes to S126. And at S126, it is judged whether or not the song data (B) is the required warning data by comparing the end term data of the song data (B) and the warning term data "2005.01.01". Since the end term data of the song data (B) is before the time and date "Jan. 1, 2005" indicated by the warning term data, the period for which the song data (B) is usable remains less than one month, whereby the song data (B) corresponds to required warning data (S126: YES). Accordingly, a warning signal is added to the song data (B) at S127.

On the other hand, a process for the song data (C) and song data (D) will be described below. Since the song data (C) and song data (D) are not the latest song data (S122: NO), the operation goes to S124. At S124, it is judged whether or not the song data is the expired data by comparing the end term data of each song data and the current time and date data. Since the use end date of the song data (C) is "May 1, 2005", and the use end date of the song data (D) is "Oct. 1, 2005", both the song data do not exceed the usable term (S124: NO). That is, the song data (C) and the song data (D) are not the expired data. And at S126, the time and date "2005.01.01" indicated by the warning term data and the end term data of each song data are compared. Herein, since the use end date of the song data (C) and the use date of the song data (D) are after the time and date "Jan.

1, 2005" indicated by the warning term data, the song data (C) and the song data (D) do not correspond to the required warning data (S126: NO). Accordingly, the required download signal, deletion signal and warning signal are not added to the song data (C) and the song data (D).

Referring to FIG. 8 again, a data management processing program will be described below in detail.

As described above, upon the end of the term comparison process (S115), the song data list with the required download signal, deletion signal or warning signal added is stored in the server storage area 85, and the data list creation process (S102) is ended.

At S103 after the data list creation process (S102), the server CPU 81 reads the data list created through the data list creation process, and transmits it via the server communication unit 83 to the typing game apparatus 1 that is an originator of the data list request signal, based on the identification signal stored in the server storage area 85.

On the other hand, the CPU 10 of the typing game apparatus 1 receives the data list transmitted from the server 80, and stores the received data list in the RAM 21 (S22). Then, the operation goes to S23.

At S23, the CPU 10 performs a term management process, based on the received data list. The term management process (S23) is the process for deleting the expired data and making a warning indication for the required warning data, based on the usable term of song data stored in the song data storage area 20*a*.

Figure 13:
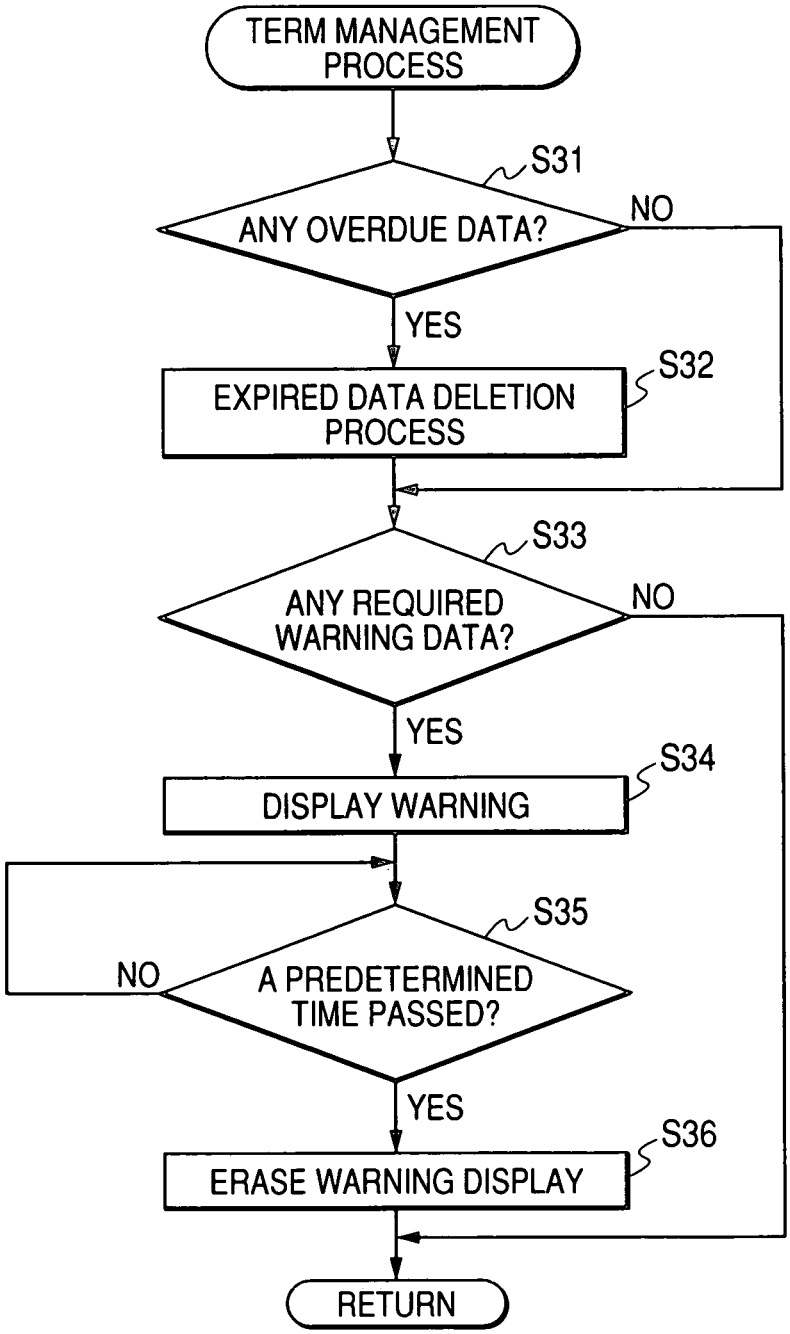
FIG. 13 is a flowchart of a term management processing program for the typing game apparatus according to this embodiment.

This term management process will be described below in detail with reference to the drawings. FIG. 13 is a flowchart of a term management processing program.

In the term management process (S23), the CPU 10 judges whether or not there is any expired data in the song data storage area 20*a*, based on the data list received at S22 (S31). That is, the data list is firstly read from the RAM 21, and a judgement is made whether or not there is any song data with the deletion signal added. If the expired data exists in the song data storage area 20*a* (S31: YES), the operation goes to S32, where the song data corresponding to the expired data is deleted from the song data storage area 20*a* (S32). After deleting all the song data corresponding to the expired data from the song data storage area 20*a*, the operation goes to S33.

In the specific example as previously described, four kinds of song data (song data (A) to song data (D)) are stored in the song data storage area 20*a* at the time of S31 (see FIG. 14A). And in the received data list, the deletion signal is added to the song data (A) (see FIG. 12).

Accordingly, the CPU 10 specifies the song data (A) that is the expired data by referring to the deletion signal, based on the data list and the deletion process for deleting the song data (A) from the song data storage area 20*a* is performed at S32. As a result, three kinds of song data including song data (B), song data (C) and song data (D) are stored in the song data storage area 20*a* at the time of S33 (see FIG. 14B).

On the other hand, if the song data corresponding to the expired data does not exist in the song data storage area 20*a* (S31: NO), the operation directly goes to S33.

At S33, the CPU 10 judges whether or not the required warning data exists in the song data storage area 20*a*, based on the data list. That is, the CPU 10 reads out the data list from the RAM 21 and judges whether or not the song data with the warning signal added exists. If the required warning data exists in the song data storage area 20*a* (S33: YES), the operation goes to S34.

On the other hand, if the song data corresponding to the required warning data does not exist in the song data storage area 20*a* (S33: YES), the term management process (S23) is directly ended, and the operation returns to the data management process.

Figure 15:
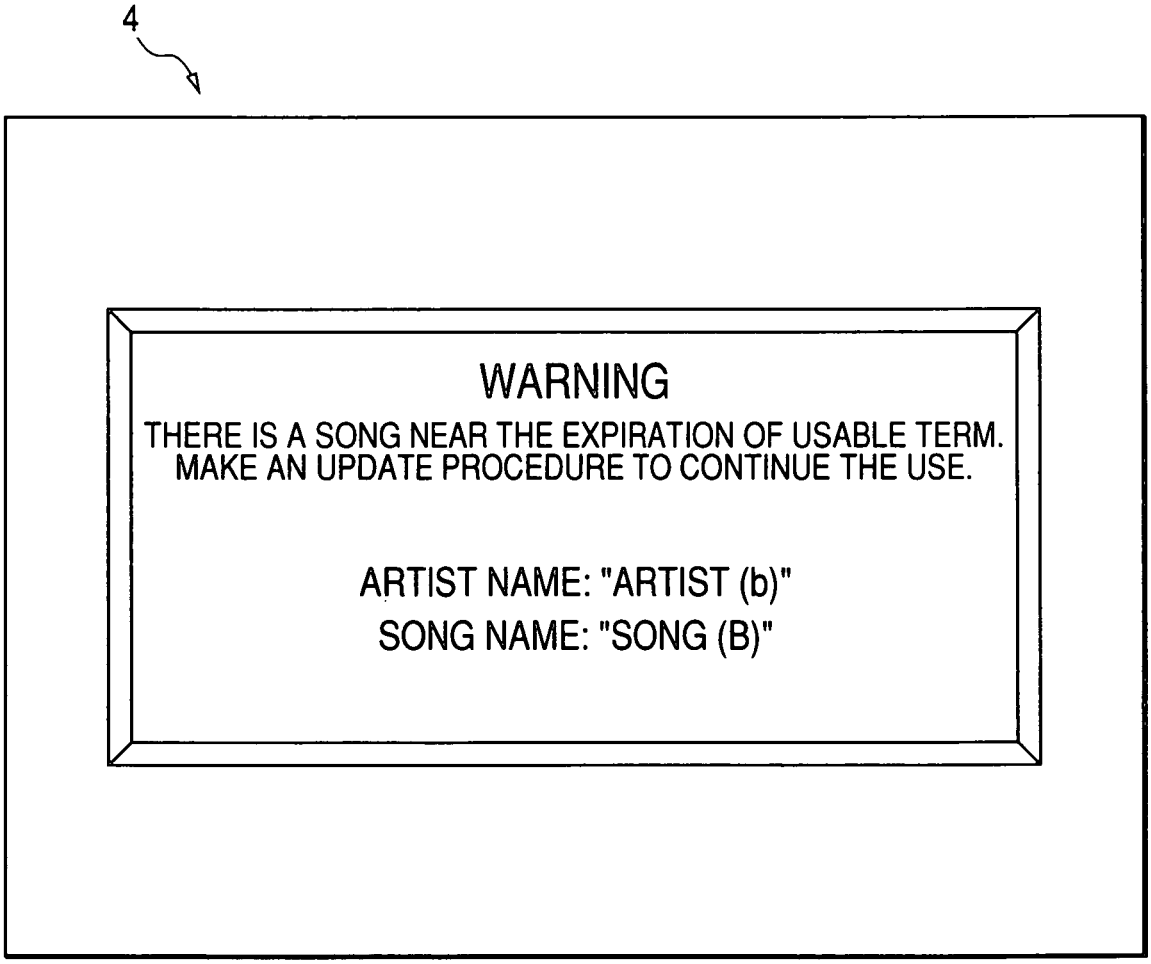
FIG. 15 is a display example of a warning indication displayed on the typing game apparatus according to this embodiment.

At S34, the CPU 10 makes a warning indication "the usable term of the song data corresponding to the required warning data is about to expire" on the first liquid crystal display 4 (see FIG. 15). Then, the operation goes to S35.

At S35, the CPU 10 judges whether or not a predetermined time (e.g., one minute) passes in a state where the warning indication is made on the first liquid crystal display 4. And if the predetermined time passes (S35: YES), the operation goes to S36. On the other hand, if the predetermined time does not pass (S35: NO), the operation returns to S35 to wait till the predetermined time passes in the state where the warning indication is displayed.

And at S36, the warning indication is erased from the first liquid crystal display 4, and the term management process (S23) is ended.

That is, at S34, the CPU 10 displays the warning indication on the first liquid crystal display 4, and starts the timer 30. And at S35, the warning indication is kept displayed till the time indicated by the timer 30 exceeds one minute, and if the value of the timer 30 indicates one minute, the warning indication is erased from the first liquid crystal display 4 (S36).

After the warning indication is erased from the first liquid crystal display 4, the term management process (S23) is ended, and the operation transfers to the data management process.

The processing from S33 to S36 will be specifically described below, based on the previous example. At this time, three kinds of song data including song data (B), song data (C) and song data (D) are stored in the song data storage area 20*a* (see FIG. 14B).

In this example as previous described, the song data (B) corresponds to the required warning data, and the warning signal is added to the song data (B) in the data list.

Accordingly, the CPU 10 judges that the required warning data exists by referring to the data list, based on the warning signal (S33: YES), and specifies the song data corresponding to the required warning data. Thereby, the song data (B) is specified as the required warning data.

And the CPU 10 displays a warning indication for the song data (B) that is the required warning data on the first liquid crystal display 4 (S34).

As shown in FIG. 15, an indication that the usable term of the song data corresponding to the required warning data is about to expire and the title or artist name of the song are displayed on the first liquid crystal display 4.

And when the warning indication is displayed on the first liquid crystal display 4, the timer 30 is started, whereby the warning indication is erased if the display of the warning indication passes for one minute (S35, S36).

In this way, the manager of the typing game apparatus 1 can particularly recognize the song data of which the usable term is about to expire by visually checking the warning indication. That is, it does not occur that the song data is deleted suddenly one day, whereby the user can fully consider whether or not the song data is required. When needed, the user may take a procedure for continuously employing the song data.

Referring to FIG. 8 again, a data management processing program after the end of the term management process (S23) will be described below in detail.

After the end of the term management process (S23), at S24, it is judged whether or not there is any required download data in the data list. That is, the CPU 10 reads the data list from the RAM 21, and judges the presence or absence of the required download data based on the required download signal. At this time, the song data corresponding to the required download data is specified based on the required download signal.

If there is any required download data in the data list (S24: YES), the operation goes to S25. At S25, the CPU 10 transmits to the server 80 a download request signal for the song data corresponding to the required download data and the identification information identifying the typing game apparatus 1 (125).

On the other hand, if the required download data does not exist in the data list (S24: NO), the data management process (S1) is directly ended.

The server CPU 81 receives an identification signal and the download request signal from the typing game apparatus 1, and stores the identification signal in the server storage area 85. And the song data corresponding to the required download data is read from the song DB 85*a*, based on the received download request signal (S105).

Thereafter, the typing game apparatus 1 is specified based on the identification signal stored in the server storage area 85 and the required download data is transmitted (S106).

The CPU 10 receives the required download data as requested, and then stores the downloaded data in the song data storage area 20*a* (S26). Then, the data management process (S1) is ended.

The processes of the typing game apparatus 1 and the server 80 after S24 will be described below with reference to the drawings, based on the specific example as previously described.

In the specific example, three kinds of song data including song data (B), song data (C) and song data (D) are stored in the song-data storage area 20*a* at the time of S24 (see FIG. 14A). And the RAM 21 stores the data list as shown in FIG. 12.

Accordingly, since the song data (E) and the song data (F) are the latest song data, with the required download signal added to each of the song data (E) and the song data (F) in the data list, as shown in FIG. 12, the identification information identifying the typing game apparatus 1 and the download request signals for the song data (E) and the song data (F) are issued to the server 80 (S24: YES, S25).

The server CPU 81 receives the identification signal and the download request signal (S104), then stores the identification information in the server storage area 85 and reads out the song data (E) and the song data (F) from among plural pieces of song data stored in the song DB 85*a* (S105). And the server CPU 81 transmits the song data (E) and the song data (F) to the typing game apparatus 1, based on the identification information stored in the server storage area 85 (S106).

On the other hand, the CPU 10 receives the song data (E) and the song data (F), and then stores the received song data in the song data storage area 20*a*. Accordingly, five kinds of song data, including song data (B), song data (C), song data (D), song data (E) and song data (F) are stored in the song data storage area 20*a* at this time (see FIG. 14C). After receiving and storing the requested song data in the song data storage area 20*a*, the data management process (S1) is ended.

In this way, when the data management process (S1) is performed, the expired data such as song data (A) is deleted from the song data storage area 20*a*. Accordingly, the song data with the definite usable term is not employed after the expiration of the term, whereby the term management for song data is strictly made.

Also, for the song data of which the usable term is about to expire, like the song data (B), a warning indication that the usable term is about to expire is made in the data management process, whereby the manager of the typing game apparatus 1 can particularly recognize the song data of which the usable term is about to expire by visually checking the warning indication. That is, it does not occur that the song data is deleted suddenly one day, whereby the user can fully consider whether or not the song data is required. When needed, the user may take a procedure for continuously employing the song data.

Moreover, the song data newly added to the server 80, like the song data (E) and the song data (F), is automatically added to the typing game apparatus 1 through a data update process (S1). Accordingly, since the user can perform the typing game at any time, employing the new song data, the interest of the player in the typing game apparatus 1 is maintained.

Figure 16:
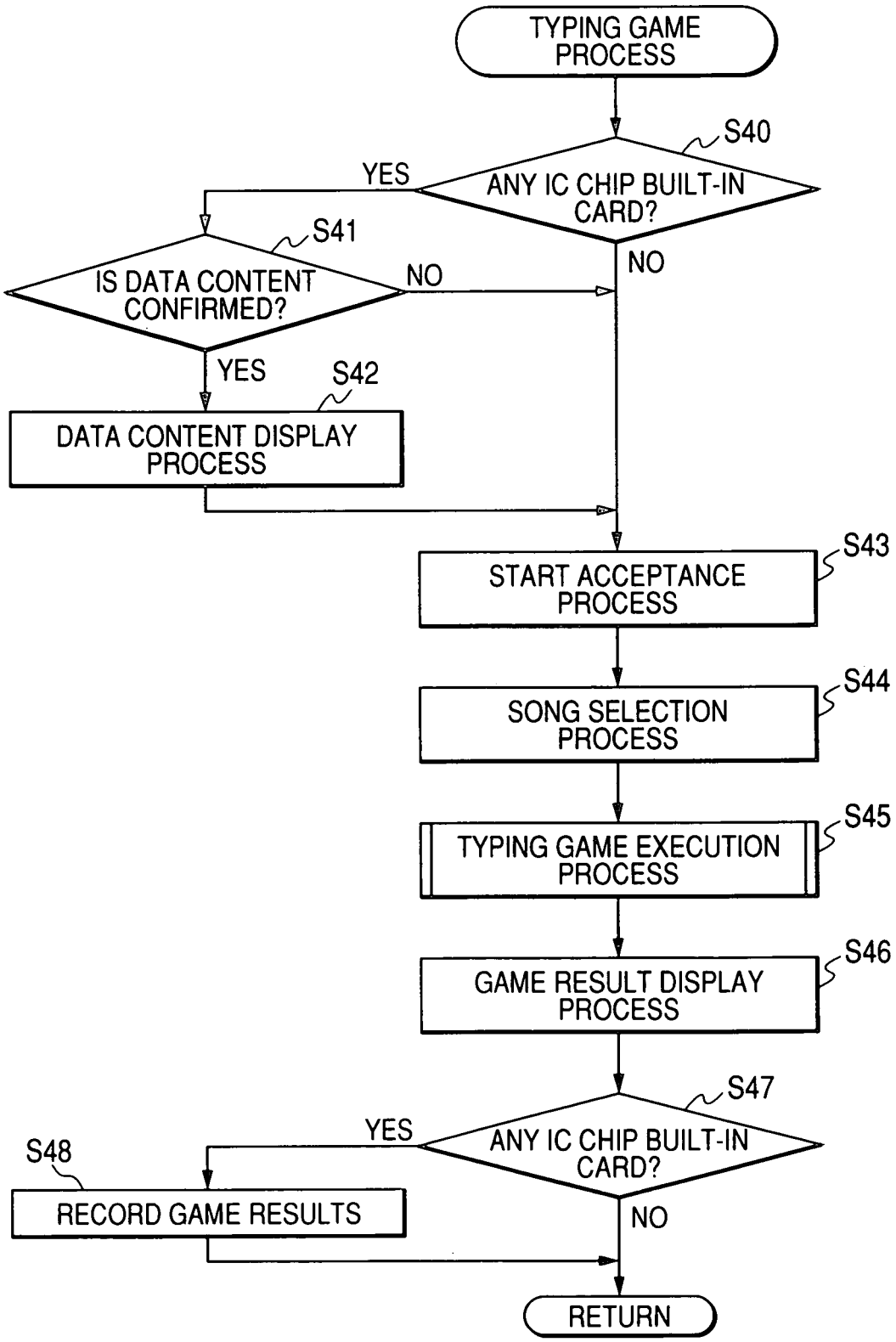
FIG. 16 is a flowchart of a typing game processing program for the typing game apparatus according to this embodiment.

A typing game process (S2) after the end of the data management process (S1) will be described below in detail with reference to the drawings. FIG. 16 is a flowchart of a typing game processing program.

In the typing game process (S2), first of all, the presence or absence of an IC chip built-in card is judged at S40. That is, it is judged whether or not any IC chip built-in card is inserted into the card insertion opening 9, based on the sensed result of the card sensor 28 disposed inside the card insertion opening 9. If the IC card built-in card is in the card insertion opening 9 (S40: YES), the operation goes to S41. On the other hand, if the IC card built-in card is not in the card insertion opening 9 (S40: NO), the operation goes to a start acceptance process (S43).

If the IC chip built-in card is inserted into the card insertion opening 9 (S40: YES), an indication of inquiring "whether or not to check the stored contents of the IC chip" is displayed on the first liquid crystal display 4 at S41, and it is judged whether or not the data contents are confirmed (S41).

Herein, if the player chooses to confirm the stored contents of the IC chip built-in card (S41: YES), the stored contents of the IC chip are read via the card reader/writer 29 and displayed on the first liquid crystal display 4 (S42). After the stored contents of the IC chip are displayed, the operation transfers to the start acceptance process (S43). On the other hand, if the player does not choose to confirm the stored contents of the IC chip built-in card from the keyboard 3 (S41: NO), the operation directly transfers to the start acceptance process (S43).

In the start acceptance process (S43), the operation for starting to execute the typing game, including initialization of the stored contents of the RAM 21, acceptance of the coin employed to perform the typing game, and the environment settings for selecting the degree of difficulty of the typing game, is performed.

After the end of the start acceptance process (S43), a song selection process (S44) is performed. In the song selection process (S44), the song data for use in the present typing game is selected from among the song data stored in the song data storage area 20*a*. Specifically, the title and artist name of song for each of all the song data stored in the song data storage area 20*a* are displayed on the first liquid crystal display 4, and the player selects the song employing the keyboard 3 to decide the song data for use in the present typing game.

In the previous example, five song names of "song data (B)", "song data (C)", "song data (D)", "song data (E)" and "song data (F)" are displayed on the first liquid crystal display 4 in the song selection process. The player selects and decides the song for use in the present typing game from among them, employing the keyboard 3.

After the song for use in the typing game is decided through the song selection process (S44), the operation transfers to a typing game execution process (S45). The typing game execution process (S45) involves the progress of the typing game, as will be described later in detail, and is not described here. After the end of the typing game execution process (S45), the operation goes to S46.

At S46, a game result display process for displaying the game result of the typing game on the first liquid crystal display 4 is performed. In the game result display process, the game result calculated from an input error of key input in the typing game performed through the typing game execution process (S45) and an input timing deviation from the determination reference data for the song data is displayed.

After the game result display process (S46), at S47, it is judged whether or not the IC chip built-in card is inserted into the card insertion opening 9. If the IC chip built-in card is inserted into the card insertion opening (S47: YES), the game result of the present typing game is recorded via the card reader/writer 29 in the IC chip (S48). After the game result is recorded in the IC chip, the typing game process (S2) is ended.

On the other hand, if the IC chip built-in card is not inserted into the card insertion opening 9 (S47: NO), the present game result is not recorded, but erased from the RAM 21, whereby the typing game result (S2) is ended.

In the typing game apparatus 1 according to this embodiment, the typing game of one game is executed by making the typing game process (S2), and ended by ending the typing game process (S2). Accordingly, the typing game apparatus 1 waits till the typing game is performed again after the end of the typing game process (S2).

Figure 17:
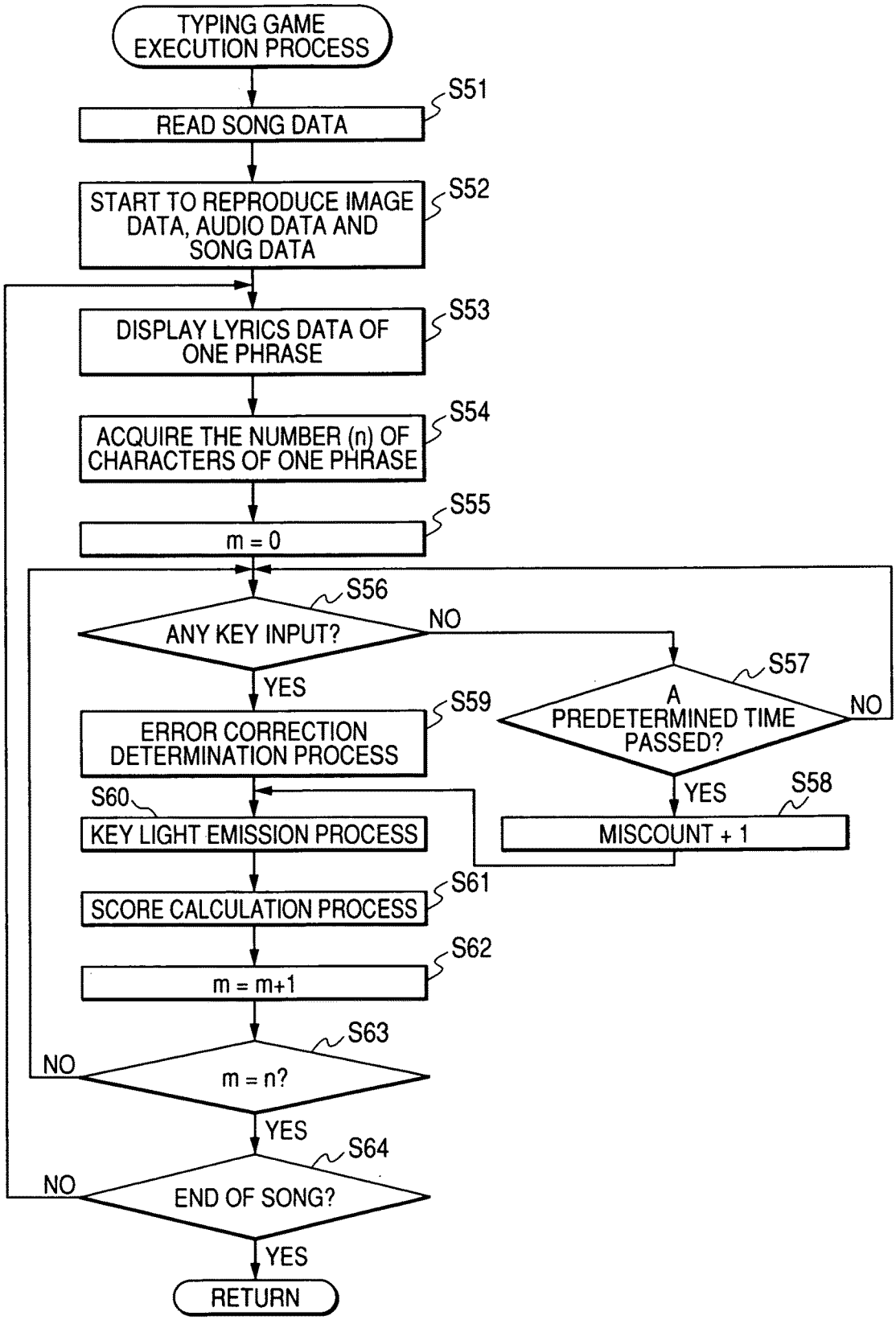
FIG. 17 is a flowchart of a typing game execution processing program for the typing game apparatus according to this embodiment.
Figure 18A:
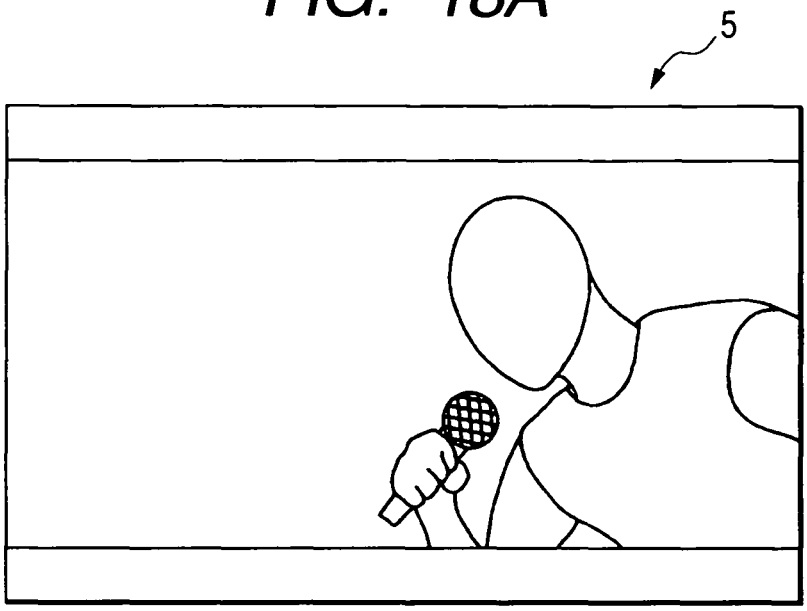
Figure 18B:
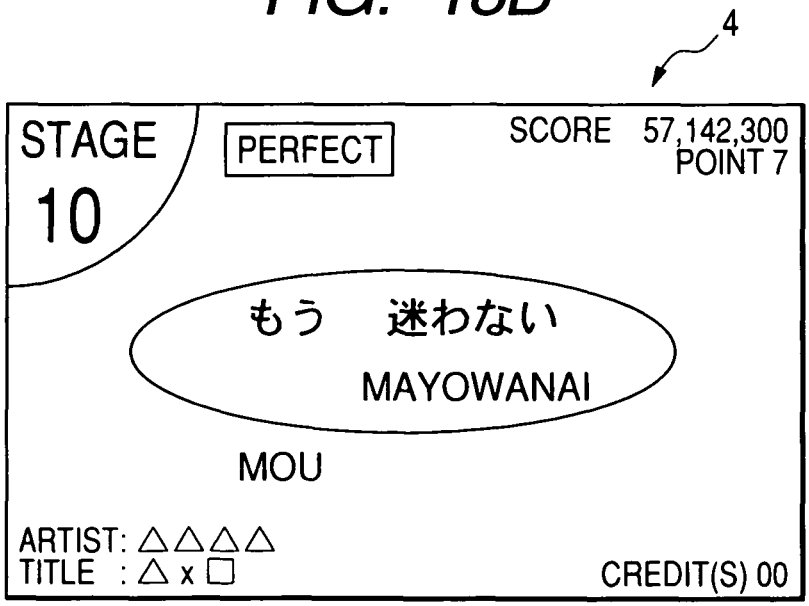
Figure 19:
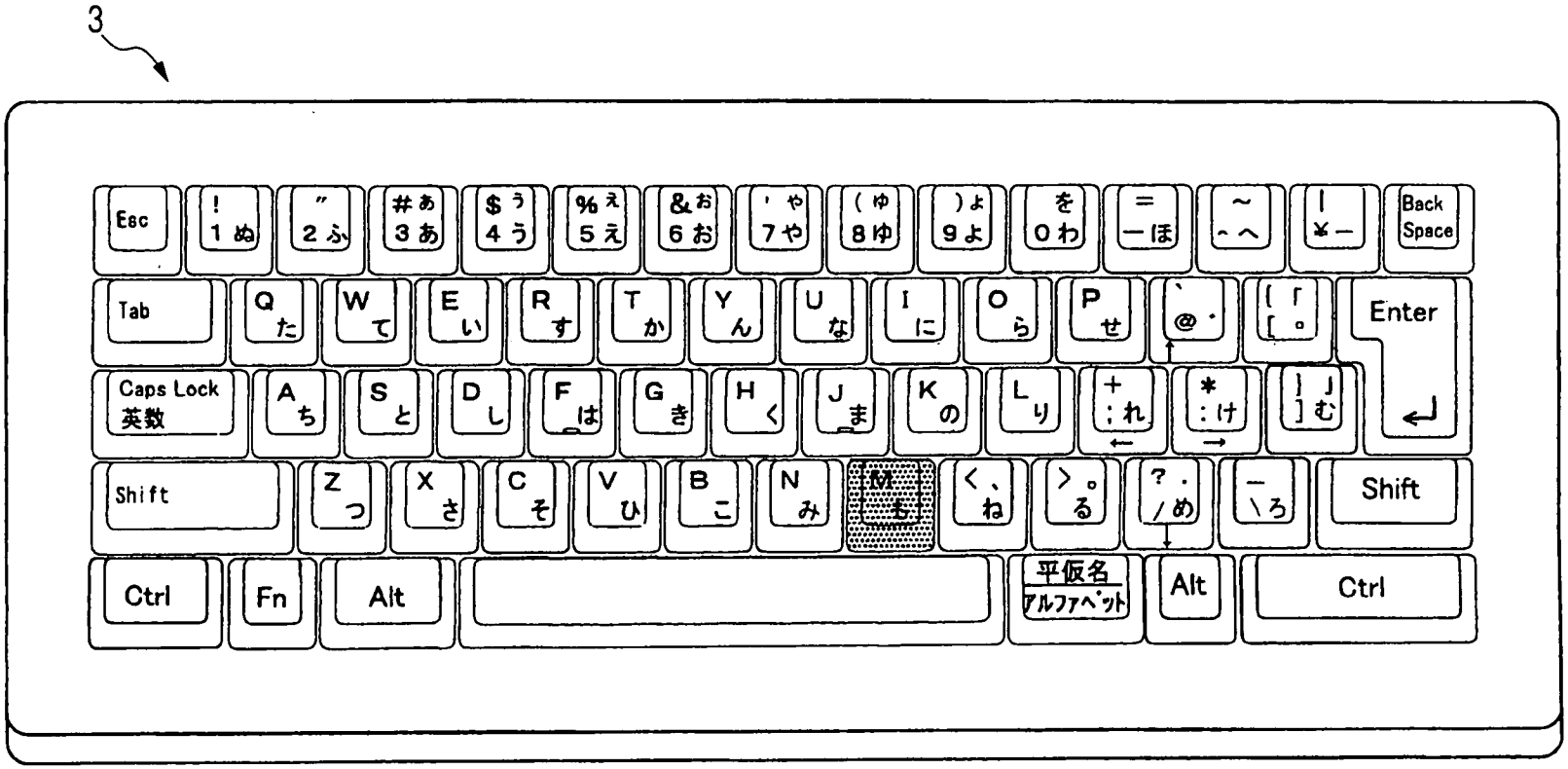
FIG. 19 is an explanatory view showing a light emission form example of the keyboard during execution of the typing game according to this embodiment.

The typing game execution process performed at S45 in the typing game process (S2) will be described below in detail with reference to the drawings. FIG. 17 is a flowchart of a typing game execution processing program. FIGS. 18A and 18B are explanatory views showing a display example on each liquid crystal display during execution of the typing game. FIG. 19 is an explanatory view showing the appearance of the keyboard 3 during execution of the typing game.

If the typing game execution processing program is performed as shown in FIG. 17, first of all, at S51, the song data selected in the song selection process (S44) is read from the song data storage area 20*a* (S51).

And the reproduction of image data, audio data and performance data making up the read song data is started (S52). At this time, the image for PV of song in the image data is displayed on the second liquid crystal display 5 (see FIG. 14A), and the audio data and performance data are outputted from the loud-speakers 7. A game screen of the typing game is displayed on the first liquid crystal display 4, based on the song data (see FIG. 14B).

And if the reproduction of the image data, audio data and performance data making up the song data is started, one phrase that is part of the lyrics data making up the song data is displayed on the first liquid crystal display 4 (S53).

The display forms of the first liquid crystal display 4 and the second liquid crystal display 5 in the typing game will be described below based on the specific example as previously described.

If the "song data (C)" is selected in the song selection process (S44) under the conditions of the specific example, the typing game is performed based on the "song data (C)". Herein, the "song data (C)" is the song data of the song that the man artist sings.

Accordingly, if the typing game using the "song data (C)" is executed, the PV (image such as how the man artist sings) of the song as shown in FIGS. 14A to 14C is displayed on the first liquid crystal display 4, and a game screen of the typing game with one phrase (I am not puzzled any longer/MOU MAYOWANAI) of the lyrics of the song to be inputted at this time is displayed on the second liquid crystal display 5.

After one phrase of the lyrics of the song is displayed on the first liquid crystal display 4, the number n of characters making up one phrase of the lyrics data displayed on the first liquid crystal display 4 is acquired (S54). For example, when "I am not puzzled any longer/MOU MAYOWANAI" is displayed as one phrase of the lyrics data (see FIG. 14B), the number n of characters making up the one phrase is the number of characters where one phrase of the lyrics is denoted in alphabets, or 12. After the number n of characters making up one phrase is acquired, m indicating the currently inputted characters in one phrase is set to zero (S55).

At S56, it is judged whether or not any of the keys 300 making up the keyboard 3 is inputted for the character string that is one phrase of the lyrics data displayed on the first liquid crystal display 4. If any of the keys 300 on the keyboard 3 is inputted (S56: YES), the operation transfers to an error correction determination process.

On the other hand, if any of the keys 300 is not inputted (S56: NO), it is judged whether a predetermined time passes from the time when the character string of the lyrics of one phrase is displayed, or the input time of previous character (S57). If the predetermined time does not pass (S57: NO), the operation returns to S56 again to accept the input of the keys 300. If the predetermined time passes without inputting any of the keys 300 (S57: YES), the CPU 10 judges that the input timing of the character to be currently inputted making up the lyrics of one phrase is missed. Accordingly, it is considered that the key input of this character is missed, whereby the CPU 10 increments a miscount by 1, and stores it in the RAM 21 (S58). The value of this miscount is employed to calculate the game score in a score calculation process (S61) as will be described later. After incrementing the miscount by 1 and storing it in the RAM 21, the operation goes to S60.

If any of the keys 300 is inputted within the predetermined time (S56: YES), the operation transfers to the error correction determination process. At S59, the error correction determination process for the inputted key 300 is performed. In this error correction determination process (S59), the error correction for the inputted key and the accuracy of the key input timing are determined by an error correction determination part 17 and a timing determination part 18, based on the determination reference data making up the song data.

That is, in this error correction determination process, the error correction determination part 17 makes a determination whether or not the keys 300 corresponding to the lyrics of the song are inputted by referring to the determination reference data, and the timing determination part 18 makes a determination whether or not the input timing of the inputted key 300 is matched with the timing in the progress of the song, based on the determination reference data.

For example, in one phrase of "I am not puzzled any longer/MOU MAYOWANAI", if the key 300 of "U" is inputted at the same timing when the singer of the song pronounces "U" in the "MOU MAYOWANAI", the highest assessment is given in the error correction determination process.

After the end of the error correction determination process (S59), a key emission process is made at S60. The key emission process is the process for lighting the LEDs 302 disposed inside each key 300 of the keyboard 3. At this time, if the inputted key 300 is correct, the LEDs 302 are lighted blue, or if it is incorrect, the LEDs 302 for the inputted key 300 are lighted red.

Also, if the key 300 is not inputted within the predetermined time (S57: YES), it is judged that the input error is made because the input timing of the character to be currently inputted is missed, whereby the key 300 corresponding to the character to be inputted is lighted yellow to notify the player of the correct key 300.

Referring to FIG. 19, the key emission process (S60) will be described below. For the convenience of illustration, the light emission key 300 is indicated with pattern to be distinguishable from the other keys 300 in FIG. 19. Accordingly, the key 300 of "M" is lighted, and the LEDs 302 disposed on the other keys 300 are not lighted in FIG. 19.

Referring to FIG. 19, the emission form of the keyboard 3 during the typing game will be described below based on the specific example as previously described. If one phrase "I am not puzzled any longer/MOU MAYOWANAI" of the lyrics of the song is displayed on the first liquid crystal display 4, and "MOU" is already inputted, the key 300 of "M" is lighted blue, when the player inputs the key 300 of "M" as the character to be inputted next.

Also, if the predetermined time passes without any input of the key 300 by the player under the same conditions, the character "M to be inputted next is lighted yellow.

Since the player bad at the touch typing often visually checks the keyboard 3 in inputting the key 300 to confirm the key 300 to be inputted, the player bad at the touch typing can recognize whether the input of the typing game is correct or not from the keyboard 3, even without seeing the first liquid crystal display 4. And the typing skill in the typing game is improved by obtaining these information.

Though in this embodiment, the keys 300 are lighted in any one of three colors of "red", "blue" and "yellow" under the existing conditions, based on the error correction for the inputted key 300, it will be appreciated that the light emission color may be changed in view of not only the error correction for the inputted key 300 but also the accuracy of the input timing of the key 300. For example, when the inputted key 300 is correct, and the input timing is accurate, the key may be lighted "blue", when the inputted key 300 is correct, but the input timing is slightly deviated, the key may be lighted "green", or when the inputted key 300 is correct, but the input timing is greatly deviated, the key may be lighted "orange".

After the end of the key emission process (S60), the operation transfers to a score calculation process at S61. In the score calculation process (S61), the game score is calculated based on the result of making steps S56 to S59, namely, the input result of the inputted key 300. In this embodiment, if the predetermined time passes without the key input (S58), or the wrong key 300 is inputted, the score is zero. And if the CPU 10 judges that the correct key 300 is inputted, the score is 200 when the input timing is accurate, the score is 100 when the input timing is slightly deviated, and the score is 50 when the input timing is greatly deviated.

After the end of the score calculation process (S61), m indicating the number of characters inputted at present is incremented by 1 (S62). At S63, it is judged whether or not m indicating the number of characters inputted at present is equal to n indicating the number of characters making up one phrase of the lyrics. If the numerical values of m and n are equal, namely, if the input of one phrase of the lyrics inputted at present is ended (S63: YES), the operation goes to S64. On the other hand, if the input of characters making up one phrase is not ended (S63: NO), the operation returns to S56 to input the next character.

At S64, it is judged whether or not the reproduction of song in the typing game is ended. The end of song is judged based on whether or not the input process for all the phrases of the lyrics data displayed on the first liquid crystal display 4 and the reproduction of image data, audio data and performance data for the song data are ended. If the song is ended (S64: YES), the typing game execution process (S45) is ended.

On the other hand, if the song is not ended (S64: NO), the operation returns to S53 to input the next phrase, whereby the typing game execution process (S45) is continued.

As described above, in the game system 100 according to this embodiment, the typing game apparatus 1 constituting the game system 100 performs the data management process (S1) to delete automatically the expired data after the elapse of the usable term from the song data storage area 20*a*. Thereby, since the usable term of each song data is strictly managed, both the server manager and the typing game apparatus manager can easily perform the data management operation for treating the expired data.

For the song data of which the usable term is about to expire, a warning indication with the title of song data and the artist name of the song is made in the data management process (S1). Thereby, the manager of the typing game apparatus can grasp which song has the usable term about to expire, namely, which song becomes unusable at which time. Accordingly, the manager of the typing game apparatus can fully examine whether the song data with the warning indication is required or not, and take a procedure for using the song data continuously, if needed.

Moreover, in the game system 100 according to this embodiment, the song data newly added to the song DB 85*a* of the server 80 can be distributed to the typing game apparatus 1 making up the game system 1. Thereby, it does not occur that no song data within the song data storage area 20*a* exists in the typing game apparatus 1 and the execution of the typing game is disabled. Further, since the latest song data is distributed from the server 80, the interest of the player in the typing game apparatus 1 is maintained.

The invention is not limited to the above embodiment, but various changes or modification may be made thereto without departing from the scope or spirit of the invention. For example, in the game system 100 according to this embodiment, a plurality of typing game apparatuses 1 are directly connected to the server 80 via the network N, but the invention is not limited to this form. For example, at the shop where a plurality of typing game apparatuses 1 are installed, a management server for managing the typing game apparatuses 1 installed at the shop may be provided between the typing game apparatuses 1 and the server 80, and connected via the network N to the server 80.

Also, though the server 80 is singly provided in this embodiment, a center server system consisting of a plurality of servers may be provided.

Also, in this embodiment, the warning for the required warning data is made only by the warning indication on the first liquid crystal display 4 in the typing game apparatus 1, but the invention is not limited to this form. For example, the warning by voice may be made in addition to the warning indication.

Moreover, the server 80 may be additionally provided with a mail server function, whereby it is possible to make the warning without actually seeing the warning indication on the first liquid crystal display 4. When adding a signal to the required warning data (S127), an electronic mail describing the same warning as the warning indication is transmitted to a mail address set by the manager of the typing game apparatus 1, whereby it is possible to make the warning without seeing the warning indication on the first liquid crystal display 4.

Though in this embodiment, the song data with the warning indication as the required warning data has the usable term less than one month at present, the invention is not limited to this term. That is, the song data with the remaining usable term less than one week may be the required warning data.

Moreover, though the warning indication in this embodiment includes the title and the artist name of the song concerning the song data corresponding to the required warning data, the residual number of days in the usable term may be additionally displayed. The residual number of days in the usable term can be calculated, employing the end term data of the song and the current time and date data of the server timer 86.

Also, the game system of the embodiment is the game system according to the first aspect of the invention, wherein the server has a time limit judgment unit for judging the warning object data that the usable term of game data hardly passes, based on the clock unit and the usable term of data, and a command unit for issuing a warning command for making a warning indicating that the usable term of the warning object data is about to expire, based on the judgment result, to the typing game apparatus.

And the typing game apparatus has a warning reporting unit for reporting the warning indicating that the usable term of the warning object data is about to expire, based on the warning command-received by the game communication unit.

Thereby, the manager of the typing game apparatus can know the game data of which the usable term is about to expire, before the game data is deleted from the typing game apparatus due to the elapse of the usable term. Accordingly, it is possible to consider how to treat in advance the game data of which the usable term is about to expire.

Also, the game system of the embodiment, wherein the typing game apparatus transmits a distribution request signal of requesting to distribute the game data stored in the storage unit via the game communication unit, and if the distribution request signal is received by the server communication unit, the server reads the game data from the storage unit and distributes it to the typing game apparatus.

Thereby, it does not occur that the game data does not exist because the expired data is deleted from the data storage unit, and the typing game in the typing game apparatus is not executable. Moreover, the game data is replenished at any time by transmitting the distribution request signal, whereby the stored contents of the data storage unit can be updated. Accordingly, the game with the latest game data can be executed at any time to attract interest of the player.

Since a typing game apparatus of the embodiment is employed in the game system, the data management needing a troublesome work, such as deleting the game data of which the usable term passes, and confirming the game data of which the usable term is about to expire, can be made by simple operation.

Since a server of the embodiment is employed in the game system, the game data can be strictly managed without employing the game data of which the usable term passes after the usable term. Thereby, the game data with definite usable term can be distributed safely with less burden of the data management on the server manager.

What is claimed is:

1. A server in which management data based on a storage content of data in use are stored in association with identification information of at least one of a plurality of apparatuses utilizing the data, wherein the server manages a plurality of data used in the at least one of the plurality of apparatuses, the server comprising:

a clock unit;

a storage unit that stores the management data for the plurality of data in use at the at least one of the plurality of apparatuses;

a time limit judgment unit that judges whether a usable term of each of the plurality of data in use at the at least one of the plurality of apparatuses is expired, based on the management data; and a command unit that issues to the at least one of the plurality of apparatuses a deletion command or a warning command based on the judgment result of the time limit judgment unit, wherein the server:

receives identification information and a data list request signal from the least one of the plurality of apparatuses, the data list request signal requesting a data list corresponding to in-use song data stored at the at least one of the plurality of apparatuses;

creates an updated data list corresponding to the at least one of the plurality of apparatuses from which the identification information is received based on the in-use song data and latest song data; and, transmits the updated data list to the at least one of the plurality of apparatuses from which the identification information is received;

wherein in creating the updated data list, the server:

acquires current date and time information from the clock unit;

judges, via the time limit judgment unit, that there is first data among the in-use song data whose usable term is scheduled to expire within a predetermined amount of time based on the current time and date information received from the clock unit, from among the plurality of data in use at the at least one of the plurality of apparatuses;

when it is judged that the first data usable term is set to expire within the predetermined amount of time, generates warning term data indicating that the usable time of the first data is scheduled to expire before the usable time of the first data expires; and, adds the warning term data information and latest data information to the updated data list;

wherein, the updated data list including the warning term data information corresponding to the first data and the latest data information is transmitted to the at least one of the plurality of apparatuses via the command unit;

wherein the at least one of the plurality of apparatuses displays a warning indication for determining whether to continue use of the first data based on the warning command; and wherein, the server:

allows the at least one of the plurality of apparatuses to perform an update procedure to update the first data when the at least one of the plurality of apparatuses determines to continue use of the first data, transmits the deletion command to delete the first data from the at least one of the plurality of apparatuses when the at least one of the plurality of apparatuses determines to discontinue use of the first data; and, when a download request signal generated by the least one of the plurality of apparatuses including a request to obtain the latest download data based on the latest data information is received by the server, transmitting the requested latest download data to the least one of the plurality of apparatuses.

2. A system comprising the server and the at least one of the plurality of apparatuses according to claim 1, wherein the at least one of the plurality of apparatuses comprises:

a data storage unit that stores data in use; and a data management unit that deletes data whose usable term is expired from the data storage unit, based on the deletion command received from the server.

3. The server according to claim 1, wherein the server identifies a second apparatus that is using a second data whose usable term is expired based on the identification information of the second apparatus and associates the deletion command with the second data whose usable term is expired and transmits the deletion command to the second apparatus, and wherein the second apparatus identifies the second data whose usable term is expired based on the deletion command received from the server and deletes data corresponding to the second data whose usable term is expired from a data storage unit.

4. The server according to claim 1, wherein the plurality of data in use include song data comprising:

image data, performance data, audio data, lyrics data, term data, and one or more of determination reference data, light emission data, and keyboard light emission data.

5. The server according to claim 4, wherein the plurality of data in use include data related with a game.

6. The server according to claim 1, wherein the time limit judgment unit specifies a latest data having a start term data indicating a start time and date that is before the current time and date and is nearest to the current time and date, and adds the latest data to a data list, wherein the command unit issues a download command for requesting distribution of the latest data when there is the latest data, and wherein the data list is further updated to add information on download when there is issuance of the download command.

7. A method of managing a song by a system including a plurality of apparatuses each including an audio control unit for outputting an audio signal based on song data and a server that is communicatively connected with the apparatuses, provides the song data in association with usable term data, manages a plurality of data used in at least one of the plurality of apparatuses, and issues a command about management of the song data, the server comprising:

a clock unit;

a storage unit that stores the management data for the plurality of data in use at the at least one of the plurality of apparatuses;

a time limit judgment unit that judges whether a usable term of each of the plurality of data in use at the at least one of the plurality of apparatuses is expired, based on the management data; and a command unit that issues to the at least one of the plurality of apparatuses a deletion command or a warning command based on the judgment result of the time limit judgment unit, the method comprising:

with the server, receiving identification information and a data list request signal from the least one of the plurality of apparatuses, the data list request signal requesting a data list corresponding to in-use song data stored at the at least one of the plurality of apparatuses;

with the server, creating an updated data list corresponding to the at least one of the plurality of apparatuses from which the identification information is received based on the in-use song data and latest song data; and, with the server, transmitting the updated data list to the at least one of the plurality of apparatuses from which the identification information is received;

wherein in creating the updated data list, the server:

acquires current date and time information from the clock unit;

judges, via the time limit judgment unit, that there is first data among the in-use song data whose usable term is scheduled to expire within a predetermined amount of time based on the current time and date information received from the clock unit, from among the plurality of data in use at the at least one of the plurality of apparatuses;

when it is judged that the first data usable term is set to expire within the predetermined amount of time, generates warning term data indicating that the usable time of the first data is scheduled to expire before the usable time of the first data expires; and, adds the warning term data information and latest data information to the updated data list;

wherein, the updated data list including the warning term data information corresponding to the first data and the latest data information is transmitted to the at least one of the plurality of apparatuses via the command unit;

wherein the at least one of the plurality of apparatuses displays a warning indication for determining whether to continue use of the first data based on the warning command; and wherein, the server:

allows the at least one of the plurality of apparatuses to perform an update procedure to update the first data when the at least one of the plurality of apparatuses determines to continue use of the first data, transmits the deletion command to delete the first data from the at least one of the plurality of apparatuses when the at least one of the plurality of apparatuses determines to discontinue use of the first data; and, when a download request signal generated by the least one of the plurality of apparatuses including a request to obtain the latest download data based on the latest data information is received by the server, transmitting the requested latest download data to the least one of the plurality of apparatuses.

8. The method according to claim 7, wherein the server identifies a second apparatus that is using second song data whose usable term is expired based on the identification information of the second apparatus and associates the deletion command with the second song data whose usable term is expired and transmits the deletion command to the second apparatus, and wherein the second apparatus identifies the second song data whose usable term is expired based on the deletion command received from the server and deletes song data corresponding to the second song data whose usable term is expired from a data storage unit included in the second apparatus.

9. The method according to claim 7, wherein the plurality of data in use include data comprising:

image data, performance data, audio data, lyrics data, term data, and one or more of determination reference data, light emission data, and keyboard light emission data.

10. The method according to claim 9, wherein the plurality of data in use include data related with a game used in the apparatus.

11. The method according to claim 7, wherein the server specifies a latest song data having a start term data indicating a start time and date that is before the current time and date and is nearest to the current time and date, adds the latest song data to a data list, and issues a download command for requesting distribution of the latest song data when there is the latest data, and wherein the data list is further updated to add information on download when there is issuance of the download command.

12. A system comprising:

a plurality of apparatuses each comprising an audio control unit that outputs an audio signal based on song data; and a server communicatively connected with the apparatuses that manages song data used in the apparatuses, provides song data in association with usable term data, manages a plurality of data used in at least one of the plurality of apparatuses, and issues a command about management of the song data, wherein the server comprises:

a clock unit;

a storage unit that stores the management data for the plurality of data in use at the at least one of the plurality of apparatuses;

a time limit judgment unit that judges whether a usable term of each of the plurality of data in use at the at least one of the plurality of apparatuses is expired, based on the management data; and a command unit that issues to the at least one of the plurality of apparatuses a deletion command or a warning command based on the judgment result of the time limit judgment unit, wherein the server:

receives identification information and a data list request signal from the least one of the plurality of apparatuses, the data list request signal requesting a data list corresponding to in-use song data stored at the at least one of the plurality of apparatuses;

creates an updated data list corresponding to the at least one of the plurality of apparatuses from which the identification information is received based on the in-use song data and latest song data; and, transmits the updated data list to the at least one of the plurality of apparatuses from which the identification information is received;

wherein in creating the updated data list, the server:

acquires current date and time information from the clock unit;

judges, via the time limit judgment unit, that there is first data among the in-use song data whose usable term is scheduled to expire within a predetermined amount of time based on the current time and date information received from the clock unit, from among the plurality of data in use at the at least one of the plurality of apparatuses;

when it is judged that the first data usable term is set to expire within the predetermined amount of time, generates warning term data indicating that the usable time of the first data is scheduled to expire before the usable time of the first data expires; and, adds the warning term data information and latest data information to the updated data list;

wherein, the updated data list including the warning term data information corresponding to the first data and the latest data information is transmitted to the at least one of the plurality of apparatuses via the command unit;

wherein the at least one of the plurality of apparatuses displays a warning indication for determining whether to continue use of the first data based on the warning command; and wherein, the server:

allows the at least one of the plurality of apparatuses to perform an update procedure to update the first data when the at least one of the plurality of apparatuses determines to continue use of the first data, transmits the deletion command to delete the first data from the at least one of the plurality of apparatuses when the at least one of the plurality of apparatuses determines to discontinue use of the first data; and, when a download request signal generated by the least one of the plurality of apparatuses including a request to obtain the latest download data based on the latest data information is received by the server, transmitting the requested latest download data to the least one of the plurality of apparatuses.

13. The system according to claim 12, wherein the server transmits to a second apparatus identified by the identification information the deletion command for deleting a second song data which is stored in the second apparatus and whose usable term is expired, and wherein the second apparatus deletes the second song data whose usable term is expired from the second apparatus based on the deletion signal received from the server.

14. The system according to claim 12, wherein the server identifies a second apparatus that is using a second song data whose usable term is expired based on the identification information of the second apparatus, and associates the deletion command with the second song data whose usable term is expired and transmits the deletion command to the second apparatus, and wherein the second apparatus identifies the second song data whose usable term is expired based on the deletion command received from the server and deletes song data corresponding to the second song data whose usable term is expired from a data storage unit included in the second apparatus.

15. The system according to claim 12, wherein the plurality of data in use comprises:

image data, performance data, audio data, lyrics data, term data, and one or more of determination reference data, light emission data, and keyboard light emission data.

16. The system according to claim 15, wherein the plurality of data in use include data related with a game used in the apparatus.

17. The system according to claim 12, wherein the server includes a central processing unit that specifies a latest song data having a start term data indicating a start time and date that is before the current time and date and is nearest to the current time and date, adds the latest song data to a data list, and issues a download command for requesting distribution of the latest song data when there is the latest data, and wherein the data list is further updated to add information on download when there is issuance of the download command.

* * * * *